US010792953B2

(12) United States Patent
McGee

(10) Patent No.: US 10,792,953 B2
(45) Date of Patent: Oct. 6, 2020

(54) TILT BOARD

(71) Applicant: SKM ADVANCED PRODUCTS LIMITED, Dublin (IE)

(72) Inventor: Pat McGee, Dublin (IE)

(73) Assignee: SKM Advanced Products Limited, Dublin (IE)

( * ) Notice: Subject to any disclaimer, the term of this patent is extended or adjusted under 35 U.S.C. 154(b) by 477 days.

(21) Appl. No.: 15/314,865

(22) PCT Filed: May 29, 2015

(86) PCT No.: PCT/EP2015/062042
§ 371 (c)(1),
(2) Date: Nov. 29, 2016

(87) PCT Pub. No.: WO2015/181384
PCT Pub. Date: Dec. 3, 2015

(65) Prior Publication Data

US 2018/0201049 A1 Jul. 19, 2018

(30) Foreign Application Priority Data

May 30, 2014 (EP) ..... 1409607

(51) Int. Cl.
*B43L 3/00* (2006.01)
*B43L 13/00* (2006.01)
(Continued)

(52) U.S. Cl.
CPC ..... *B43L 3/005* (2013.01); *B43L 5/00* (2013.01); *B43L 13/005* (2013.01); *A47B 27/14* (2013.01); *A63B 2208/02* (2013.01); *B43L 5/002* (2013.01)

(58) Field of Classification Search
CPC ..... B43L 3/005; B43L 13/005; B43L 5/002; A47B 27/14
(Continued)

(56) References Cited

U.S. PATENT DOCUMENTS 2,187,574 A 1/1940 Nigra
2,215,462 A 9/1940 Davidson, Jr. et al.
(Continued)

FOREIGN PATENT DOCUMENTS

DE 808328 7/1951
FR 2975880 12/2012
WO 2015181384 A1 12/2015

OTHER PUBLICATIONS

International Search Report issued in PCT/EP2015/062042 dated Dec. 3, 2015 in parent PCT application.

*Primary Examiner* — Matthew W Ing
(74) *Attorney, Agent, or Firm* — Brian J. Colandreo; Michael T. Abramson; Holland & Knight LLP

(57) ABSTRACT

There is provided to a tilt board (1, 51, 61, 101) comprising an activity surface (3) supported by a base (5). The base comprises a front wall (7) and a rear wall (9) that extends downwardly from the activity surface by a greater distance than the front wall. The activity surface (3) comprises an activity surface surround (15) defining an aperture (17) therein and a removable activity surface insert (19) dimensioned for reception in the aperture. A plurality of interchangeable activity surface inserts (19) may be provided. The activity surface inserts (19) are also tilt adjustable relative to the remainder of the tilt board. The tilt board (1, 51, 61, 101) is provided with a circumferential flange so that the tilt board may be inserted into an aperture of a larger work surface such as a table if desired. The tilt board can be used for a range of activities, can lie flat in a larger work
(Continued)

surface if desired, and the tilt angle can be adjusted to several angles which is highly advantageous.

17 Claims, 26 Drawing Sheets

(51) Int. Cl.
*B43L 5/00* (2006.01)
*A47B 27/14* (2006.01)

(58) Field of Classification Search
USPC ..... 312/408
See application file for complete search history.

(56) References Cited

U.S. PATENT DOCUMENTS

| | | | | |
|---|---|---|---|---|
| 4,836,783 | A | 6/1989 | Harper | |
| 5,947,574 | A * | 9/1999 | Avendano | A47B 96/062 312/351 |
| 6,488,347 | B1 * | 12/2002 | Bienick | A47B 96/027 108/108 |
| 8,529,000 | B2 * | 9/2013 | Lim | B29C 65/08 312/408 |
| 8,966,932 | B2 * | 3/2015 | Lee | F25D 11/006 312/408 |
| 2005/0157505 | A1 | 7/2005 | Dow et al. | |
| 2011/0089800 | A1 * | 4/2011 | Nash | A47B 96/028 312/404 |
| 2011/0115356 | A1 * | 5/2011 | Nash | A47B 96/021 312/408 |

* cited by examiner

TILT BOARD

CROSS-REFERENCE TO RELATED APPLICATIONS

This application is a U.S. National Stage of International Patent Application No. PCT/EP2015/062042, filed 29 May 2015, which claims priority to Great Britain Patent Application No: 1409607.7, filed on 30 May 2014, the disclosure of which is incorporated herein by reference in its entirety.

TECHNICAL FIELD

This invention relates to a tilt board.

BACKGROUND ART

Tilt boards are commonly used by teachers and occupational therapists when working with children and adults with low muscle tone and/or poor posture. The tilt board allows the child or adult to maintain an upright sitting position when working or playing on the tilt board. It is also known for those with Developmental Co-ordination Disorder (DCD) and related conditions, delay in fine or gross motor skills, muscular or neuromuscular conditions to benefit greatly from the use of a tilt board. The tilt boards are not only used in a teaching or classroom environment but are also commonly used in the home and office environments.

Heretofore, tilt boards generally comprise an activity surface supported on a plurality of legs or a base. The tilt boards present an inclined surface, referred to hereinafter as an activity surface, to the user on which they can write, draw, paint or carry out other activities. Typically, the known tilt boards are constructed from wood or are moulded from a single unitary piece of plastic to provide a lightweight tilt board and one that lends itself to being stacked with other tilt boards.

Although the known tilt boards have numerous benefits and are generally well received, there are a number of problems associated with the known constructions of tilt boards. Most importantly, the known constructions of tilt boards are relatively limited in their functionality. Essentially, the tilt boards perform one function in that they provide an inclined work surface on which the user may write, draw or paint but they are suitable for little else. This is undesirable in many home, classroom and office environments where space is at a premium. Secondly, the known tilt boards are fixed and offer little or no adjustment to the angle of tilt. Therefore, it is often the case that the tilt board is not at the optimum tilt angle for the user and may require props or shims to achieve the optimum tilt angle for that user. Furthermore, different tilt boards with different angles of tilt may be required for different users and the tilt boards are not truly interchangeable.

It is an object of the present invention to provide a tilt board that overcomes at least some of the problems with the known tilt boards. It is a further object of the present invention to provide a tilt board that offers a useful choice to the consumer.

SUMMARY OF INVENTION

According to the invention there is provided a tilt board comprising an activity surface supported by a base, the activity surface comprising an activity surface surround defining an aperture therein and a removable activity surface insert dimensioned for close-fit reception in the aperture, and in which the base comprises a front wall and a rear wall extending downwardly from the activity surface substantially perpendicular to the plane of the activity surface surround, the rear wall extending downwardly from the activity surface by a greater distance than the front wall.

By having such a tilt board, the activity surface insert may be reversed or interchanged with other activity surface inserts in order to present different angles of tilt or alternative configurations for different activities. This will expand the functionality and increase the usefulness of the tilt board which is highly desirable. Importantly, by having the front and rear walls extending downwardly substantially perpendicular to the plane of the activity surface surround, the tilt board may be inserted into a suitably dimensioned aperture in a table in such a way that the activity surface surround will lie flat on the table. Furthermore, the tilt board may be inserted into a suitably dimensioned aperture in a table in such a way that the activity surface surround is inclined relative to the surface of the table. Advantageously, this provides a greater range of adjustment for the user.

In one embodiment of the invention there is provided a tilt board in which there is provided a plurality of interchangeable removable activity surface inserts, each of which is dimensioned for reception in the aperture. By having a plurality of interchangeable removable activity surface inserts, it is possible to provide several different work surfaces, games, activities and the like on the different inserts thereby expanding the functionality of the tilt board. Furthermore, there are additional physical and/or intellectual benefits brought about by the use of different inserts. In relation to the physical benefits, different inserts will allow for a variety of activities including, but not limited to, reaching, stretching and/or extending. In other words, the different inserts will require a variety of movements which may benefit one or more of posture, muscle tone, balance, concentration, blood flow and the digestive system. In relation to the intellectual benefits, by having a number of different inserts, there will be more tasks to carry out. This may help to stimulate the brain and may require added concentration above and beyond that required for a standard tilt board.

In one embodiment of the invention there is provided a tilt board in which there is provided means to adjust the tilt angle of the removable activity surface insert relative to the activity surface surround. This is seen as a particularly preferred embodiment of the present invention. By allowing adjustment of the removable activity surface insert relative to the activity surface surround, the tilt board can be used for many other activities and by more individuals as the range of adjustment of the tilt board will be improved.

In one embodiment of the invention there is provided a tilt board in which the means to adjust the tilt angle of the removable activity surface insert relative to the activity surface surround comprises: a support arm mounted on one of the activity surface insert and the activity surface surround; and, a support arm receiver located on the other of the activity surface insert and the activity surface surround. This is seen as a particularly simple and effective way of providing a good degree of adjustability to the tilt board.

In one embodiment of the invention there is provided a tilt board in which the support arm is hingedly mounted so that it may be transitioned to and from one of an operating position and a stowed position.

In one embodiment of the invention there is provided a tilt board in which the means to adjust the tilt angle of the removable activity surface insert relative to the activity surface surround comprises an inclined channel formed in a side wall of the aperture in the activity surface surround, the channel being dimensioned to receive at least part of a side edge of the activity surface insert therein. This is seen as another useful way of providing adjustability to the tilt board that will be inexpensive to provide yet will allow simple and fast adjustment of the tilt board angle.

In one embodiment of the invention there is provided a tilt board in which there is provided a plurality of inclined channels formed in the side wall of the aperture in the activity surface surround, the plurality of inclined channels being nonparallel with respect to each other to provide a range of tilt angles of the removable activity surface insert relative to the activity surface surround.

In one embodiment of the invention there is provided a tilt board in which for each inclined channel formed in the side wall of the aperture, there is provided a complementary inclined channel dimensioned to receive at least part of a side edge of the activity surface insert therein formed in the opposite side wall of the aperture.

In one embodiment of the invention there is provided a tilt board in which the base further comprises a pair of side walls bridging the gap between the front wall and the rear wall at either ends of the front wall and the rear wall. In one embodiment of the invention, there is provided a notch in each of the pair of side walls adjacent the rear wall.

In one embodiment of the invention there is provided a tilt board in which the activity surface surround comprises a circumferential flange extending outwardly from the base. This is seen as a preferred embodiment of the present invention. By having a circumferential flange, the tilt board can also be placed in existing apertures in tables thereby presenting a flat working surface for the user which may be desirable in certain instances.

In one embodiment of the invention there is provided a tilt board in which there is provided means to adjust the tilt angle of the tilt board relative to the surface on which the tilt board is mounted, to and from a tilted configuration in which the activity surface is tilted relative to the surface on which the tilt board is mounted to a substantially parallel configuration in which the activity surface is substantially parallel to the surface on which the tilt board is mounted. This is seen as another preferred embodiment of the present invention as by having such a feature, it is possible to convert the tilt board into a raised flat platform on which a game or other activity can be placed thereby allowing multiple users to use the tilt board.

In one embodiment of the invention there is provided a tilt board in which the means to adjust the tilt angle of the tilt board relative to the surface on which the tilt board is mounted comprises a tilt board support leg mounted on the tilt board.

In one embodiment of the invention there is provided a tilt board in which the tilt board support leg is hingedly mounted so that it may be transitioned to and from one of an operating position and a stowed position.

In one embodiment of the invention there is provided a tilt board in which there is provided a retaining member for releasably securing the removable activity surface insert in the aperture of the activity surface. The retaining member may be rotatably mounted on the activity surface.

In one embodiment of the invention there is provided a tilt board in which there is provided a cut-out in one of the walls of the base. By providing a cut-out, the tilt board can be transported by gripping the tilt board at the cut-out portion which will effectively act as a handle.

In one embodiment of the invention there is provided a tilt board in which there is provided an elongate upstanding boss extending at least partially along one edge of the removable activity surface insert.

BRIEF DESCRIPTION OF THE DRAWINGS

The invention will now be more clearly understood from the following description of some embodiments thereof given by way of example only with reference to the accompanying drawings, in which:—

DETAILED DESCRIPTION OF THE DRAWINGS

Figure 1:
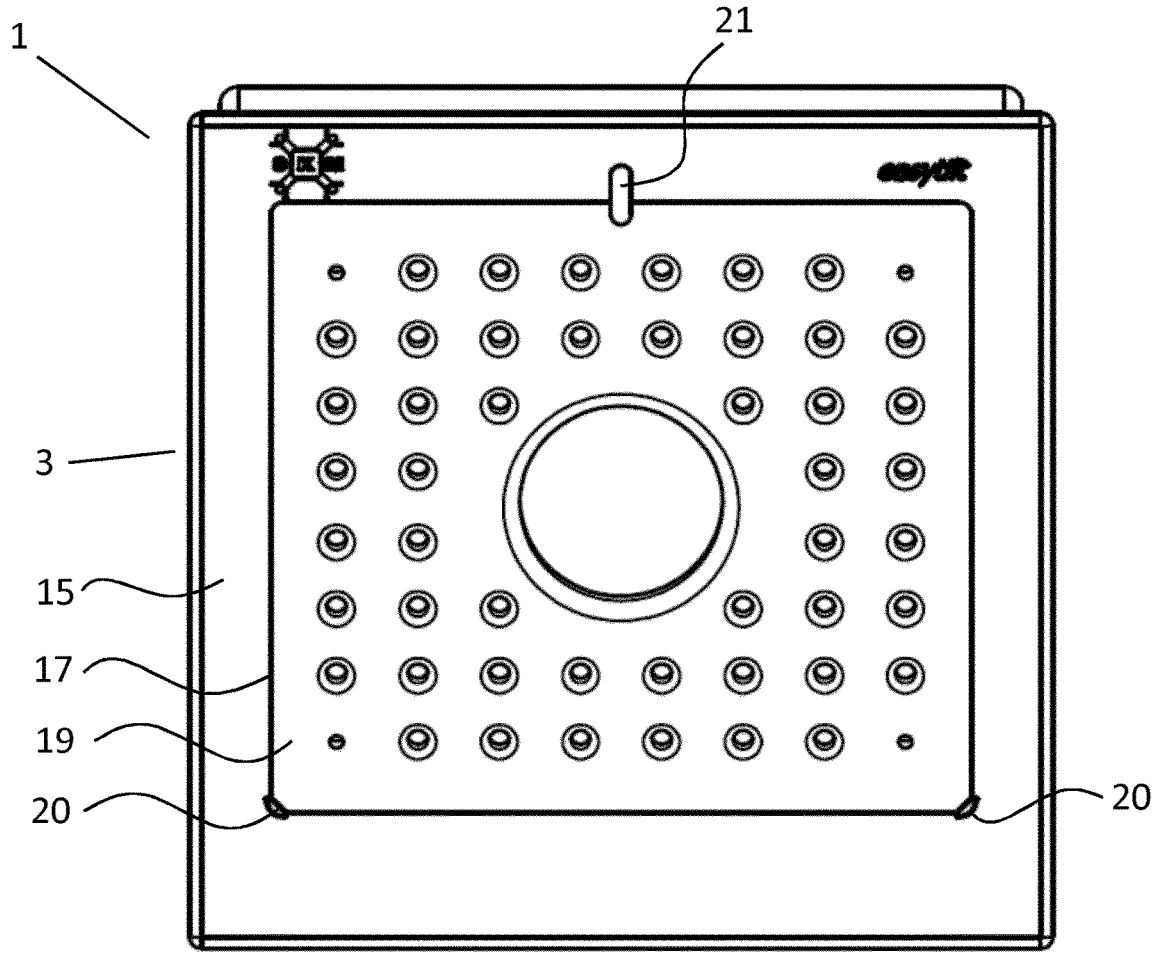
FIG. 1 is a top plan view of a tilt board according to the invention.
Figure 2:
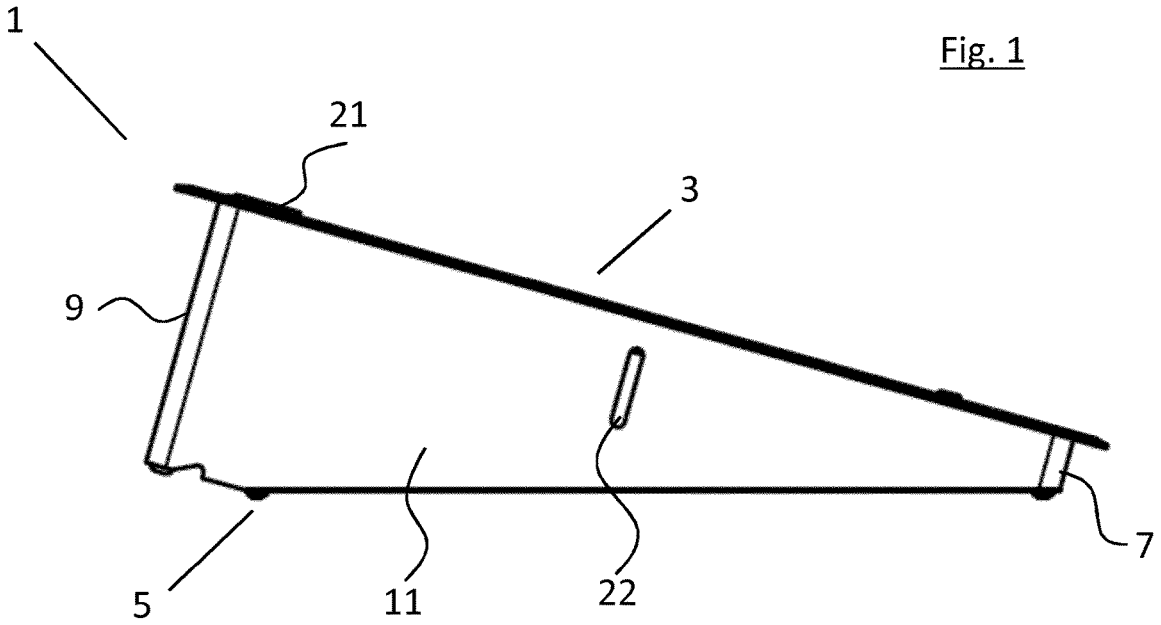
FIG. 2 is a side view of the tilt board of FIG. 1.

Referring to the drawings and initially to FIGS. 1 to 12 thereof, there is shown a tilt board, indicated generally by the reference numeral 1, comprising an activity surface 3 supported by a base 5. The base comprises a front wall 7, a rear wall 9 which extends downwardly from the activity surface by a greater distance that the front wall 7, and a pair of side walls 11, 13 that bridge the gaps between each end of the front wall 7 and rear wall 9. The tilt board further comprises an activity surface surround 15 which extends outwardly beyond the walls of the base in a circumferential flange and the activity surface surround 15 defines an aperture 17 therein. A removable activity surface insert 19 is located in and is dimensioned for a dose-fit in the aperture 17.

Ideally, there will be provided a plurality of removable activity surface inserts 19 which may be interchanged depending on the activity that it is desired to do on the tilt board. In the embodiment shown, there are provided a plurality of apertures in the removable activity surface insert 19 and these may be for a game or dexterity building activity. A simple planar surface, such as that shown in FIG. 12, may be provided for other activities.

A retaining member 21 and a pair of retaining stops 20 are provided for releasably securing the removable activity surface insert 19 in the aperture of the activity surface 3. The retaining stops 20 sit above the corners of the aperture 17 and prevent inadvertent removal of the removable activity surface insert 19. The retaining member 21 is rotatably mounted on the surface of the activity surface surround and is rotatable to and from a position over the removable activity surface insert 19 keeping it in position in the aperture 17 and a position free of the removable activity surface insert 19 allowing removal of the removable activity surface insert 19. A slot 22 is provided in at least one of the side walls 11, 13. The slot is suitable for reception of a nut and bolt for securing the tilt board in position in an aperture in a table or the like as will be described in more detail below.

Figure 3:
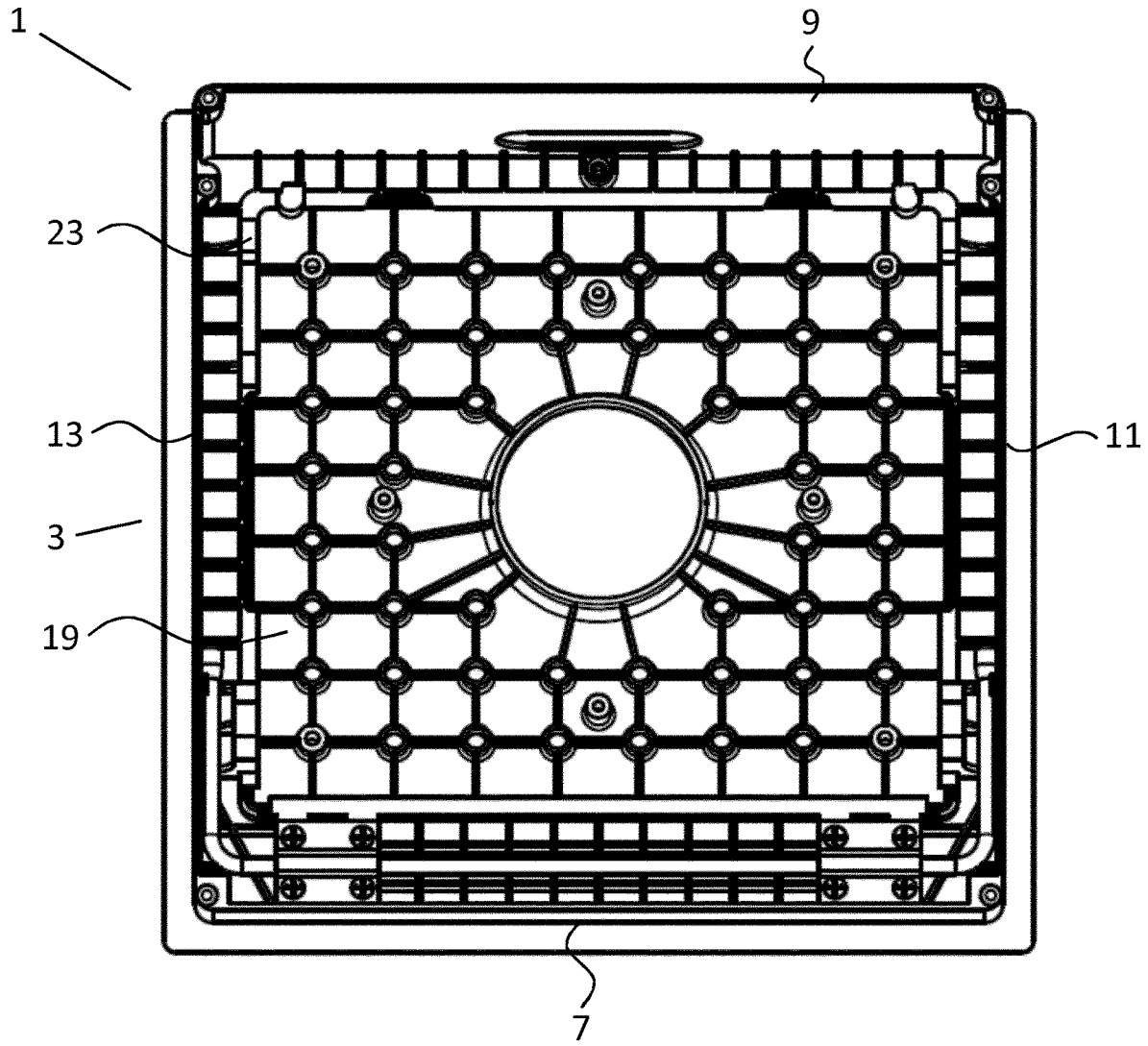
FIG. 3 is a bottom plan view of the tilt board of FIG. 1.
Figure 4:
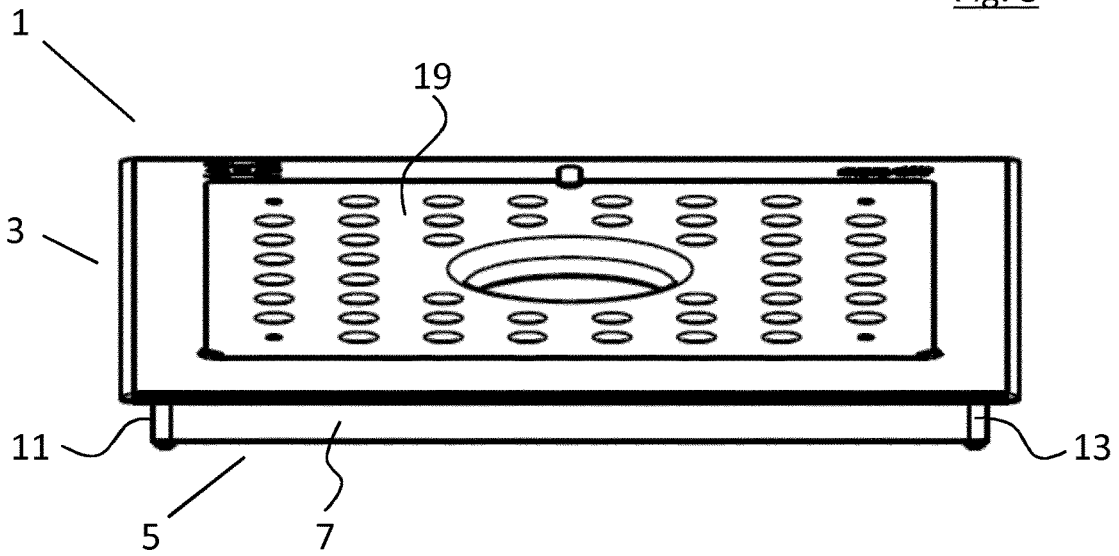
FIG. 4 is a front view of the tilt board of FIG. 1.
Figure 5:
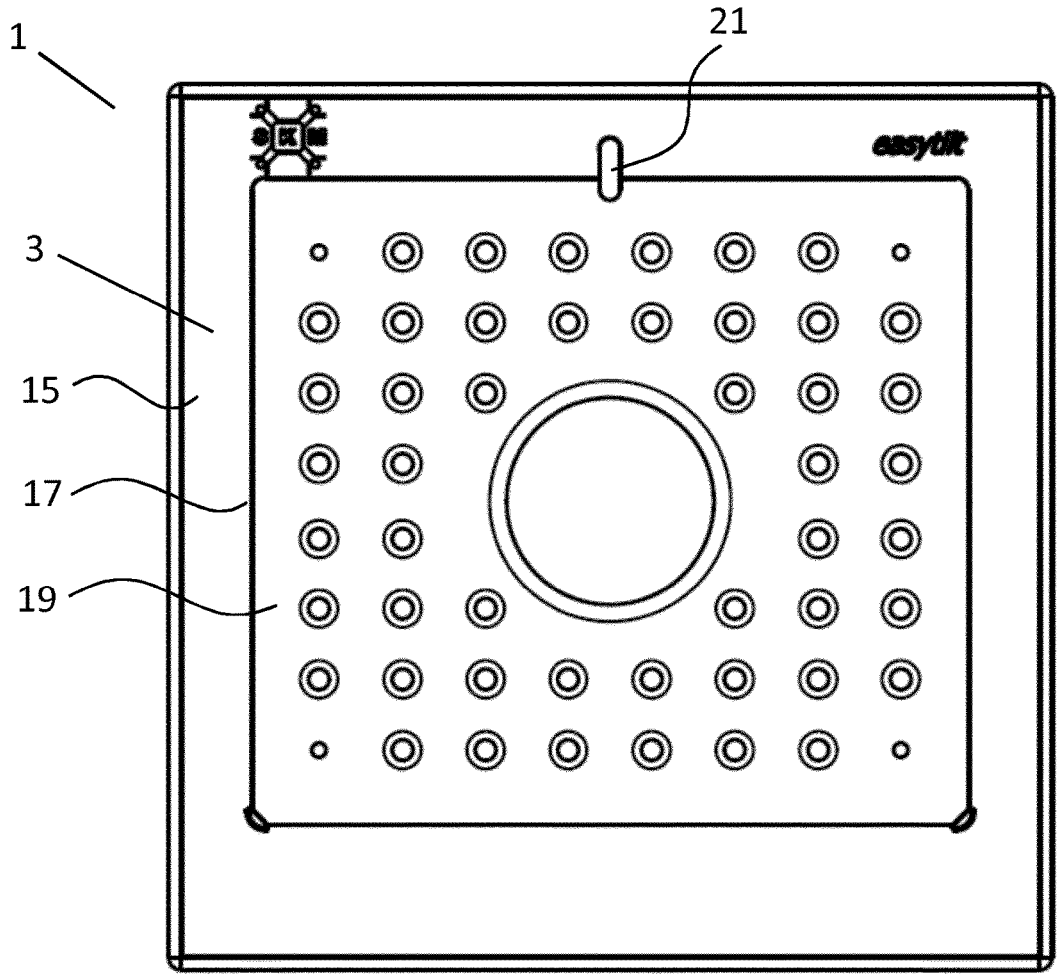
FIG. 5 is a top plan view of the tilt board of FIG. 1 with the tilt board support leg deployed.
Figure 6:
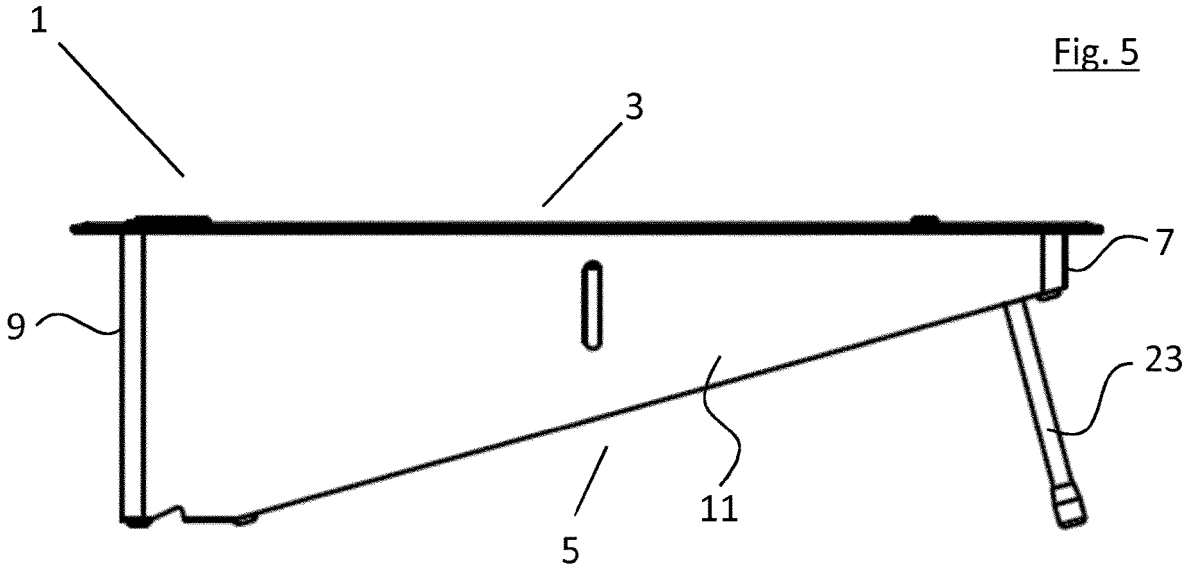
FIG. 6 is a side view of the tilt board of FIG. 5.
Figure 7:
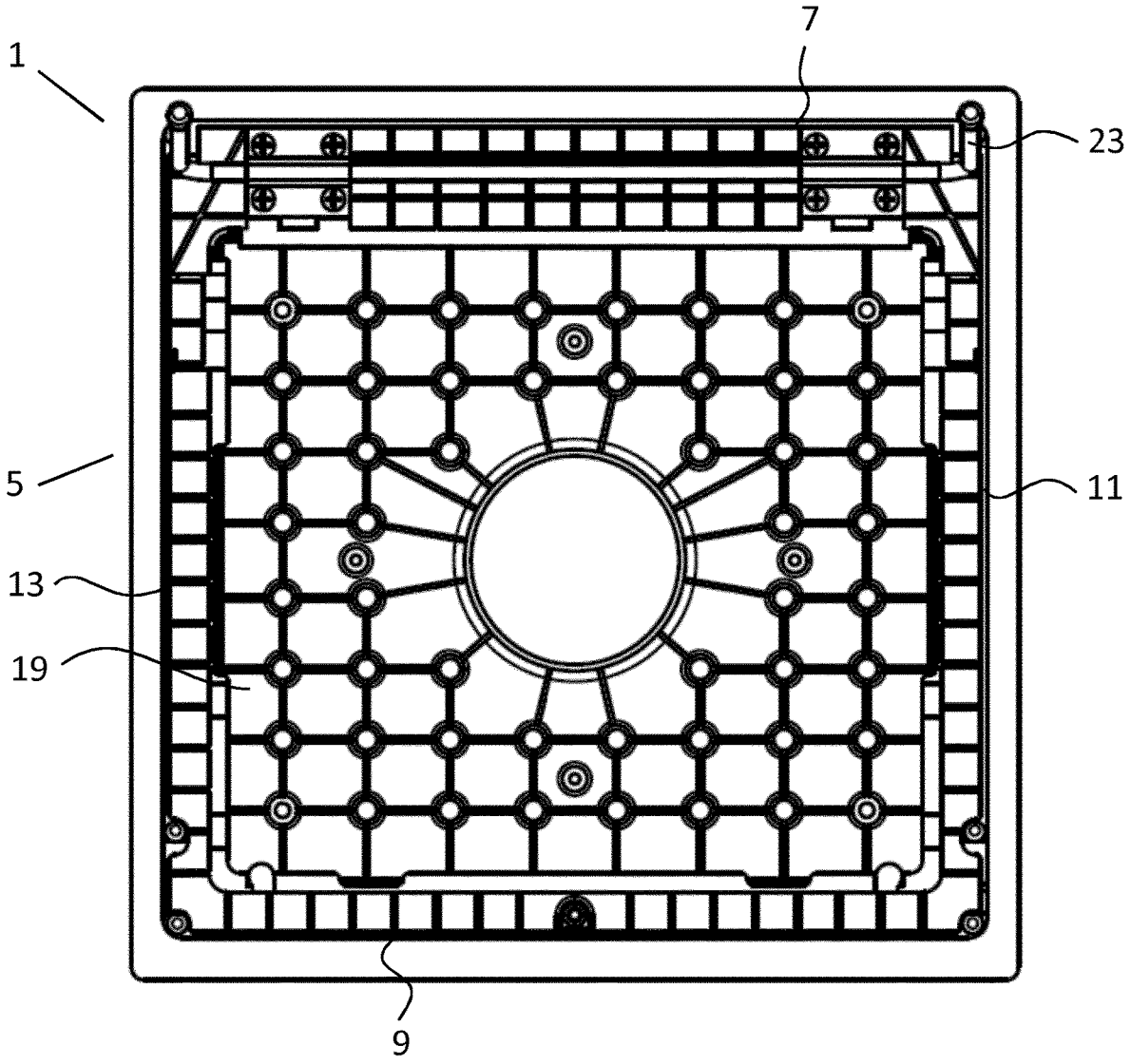
FIG. 7 is a bottom plan view of the tilt board of FIG. 5.
Figure 8:
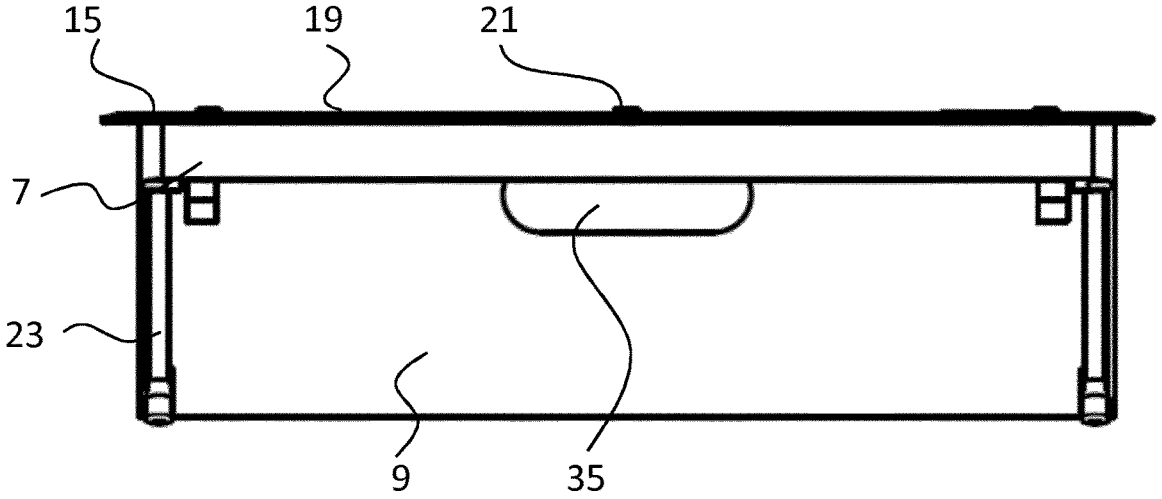
FIG. 8 is a front view of the tilt board of FIG. 5.
Figure 9:
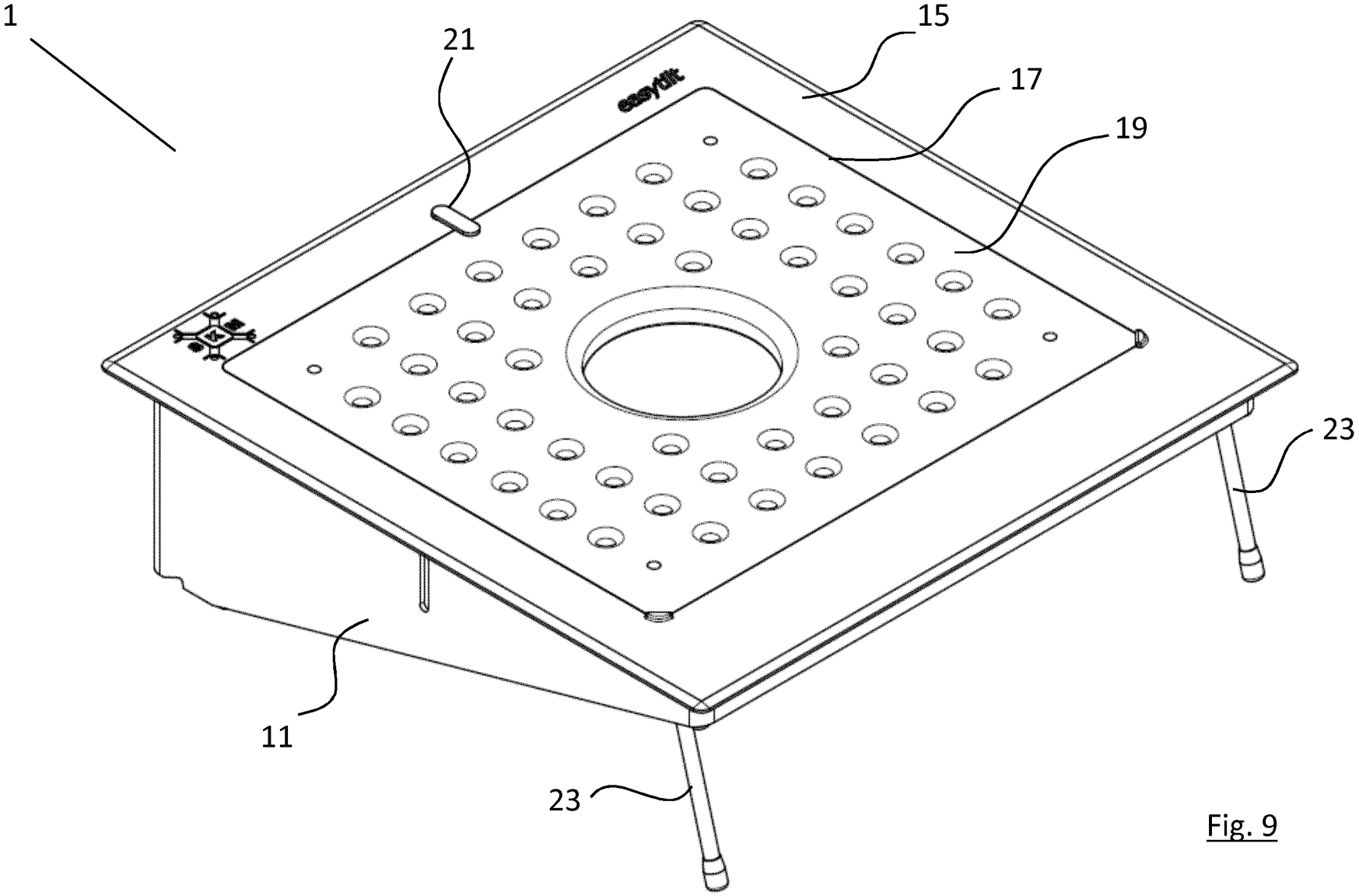
FIG. 9 is a front perspective view of the tilt board of FIG. 5.

Referring specifically to FIGS. 6 to 10 inclusive, there is shown a tilt board support leg 23 in a deployed configuration. The tilt board support leg 23 is used to adjust the tilt angle of the tilt board 1 relative to the surface on which the tilt board is mounted. By deploying the tilt board support leg 23 in the manner shown, it will be possible to effectively present a raised surface on which a board game or other activity can be enjoyed by one or more individuals. Referring now to FIGS. 3 and 11, it can be seen that the tilt board support leg folds away into a stowed configuration in which the tilt board can be used in the normal tilted configuration.

Figure 12:
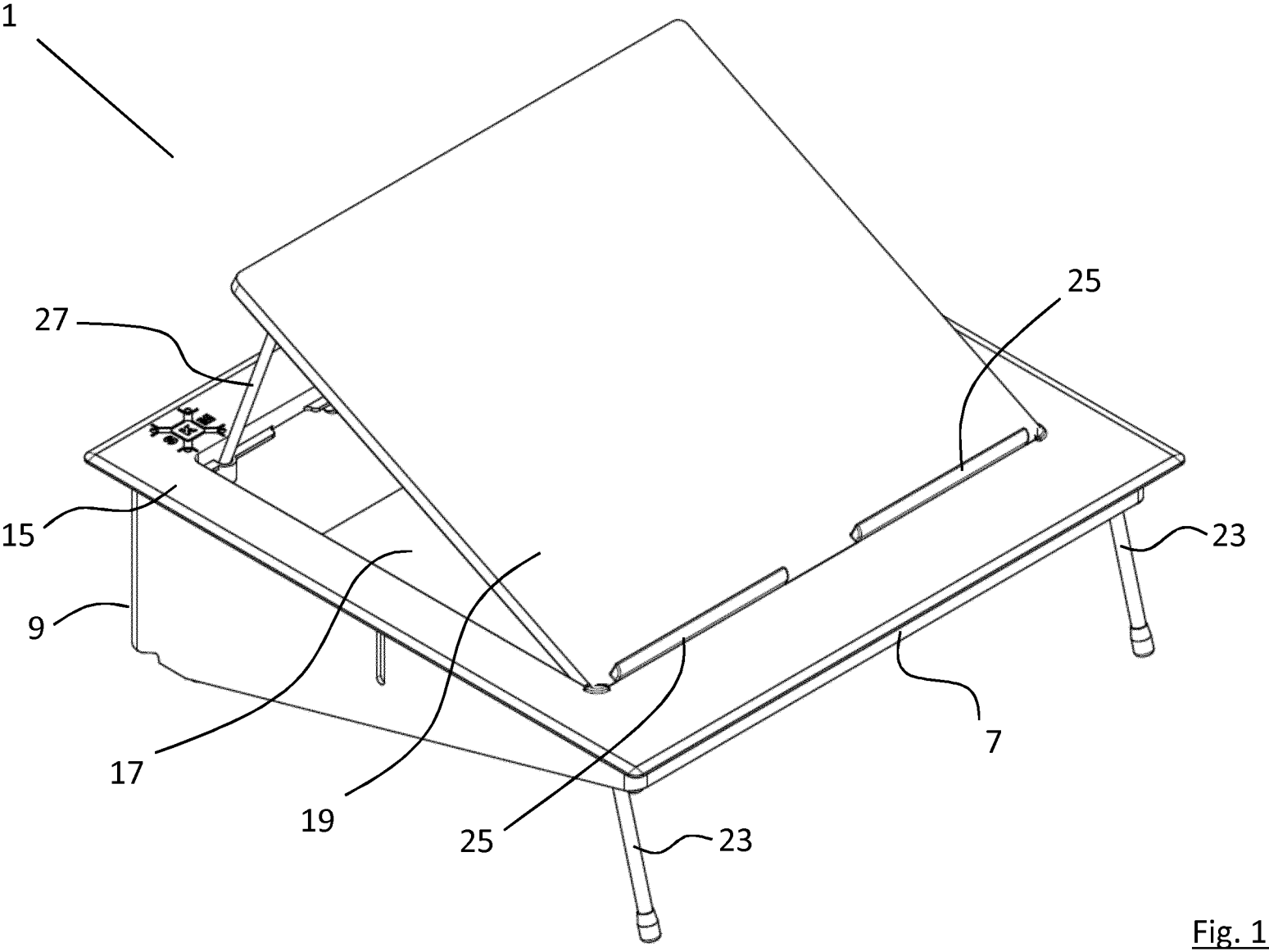
FIG. 12 is front perspective view of the tilt board of FIG. 5 with the activity surface insert in a first inclined configuration.

Referring now to FIG. 12, there is shown an alternative construction of removable activity surface insert 19 mounted in the aperture 17. The removable activity surface insert 19 comprises a flat planar surface and an elongate upstanding boss 25 extending at least partially along one edge of the removable activity surface insert 19. The removable activity surface insert 19 is raised up on a support arm 27 which is hingedly mounted to the underside of the removable activity surface insert 19. A support arm receiver (not shown) is provided on the frame of the activity surface adjacent to the aperture 17 to receive the support arm. The support arm is hingedly mounted on the removable activity surface insert 19 so that it may be stowed away when it is desirable to have the removable activity surface insert 19 lying flat in the aperture 17. If desired, a plurality of support arm receivers may be provided to allow for different angles of tilt of the removable activity surface insert 19.

Figure 10:
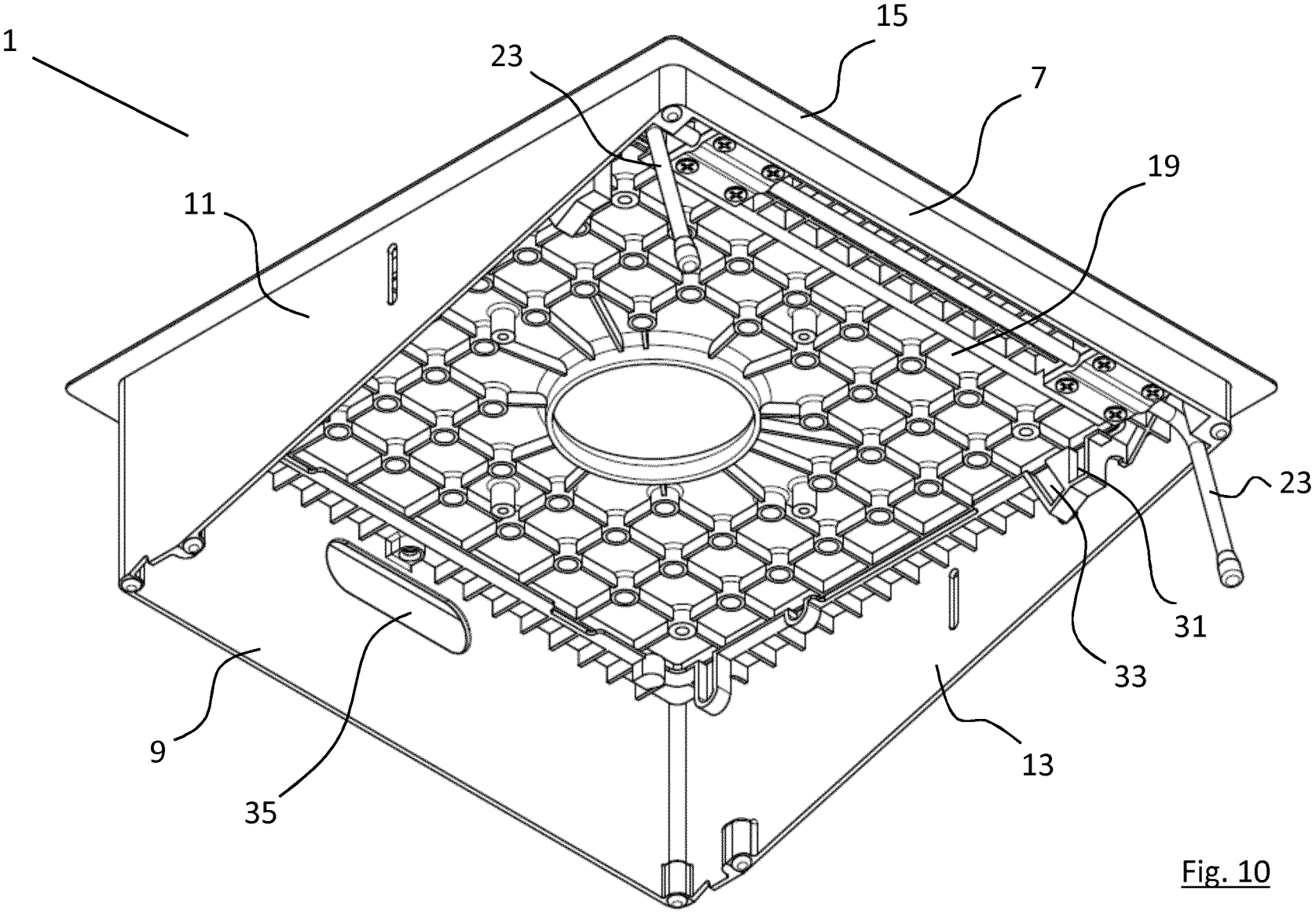
FIG. 10 is a front perspective view from underneath of the tilt board of FIG. 5.
Figure 11:
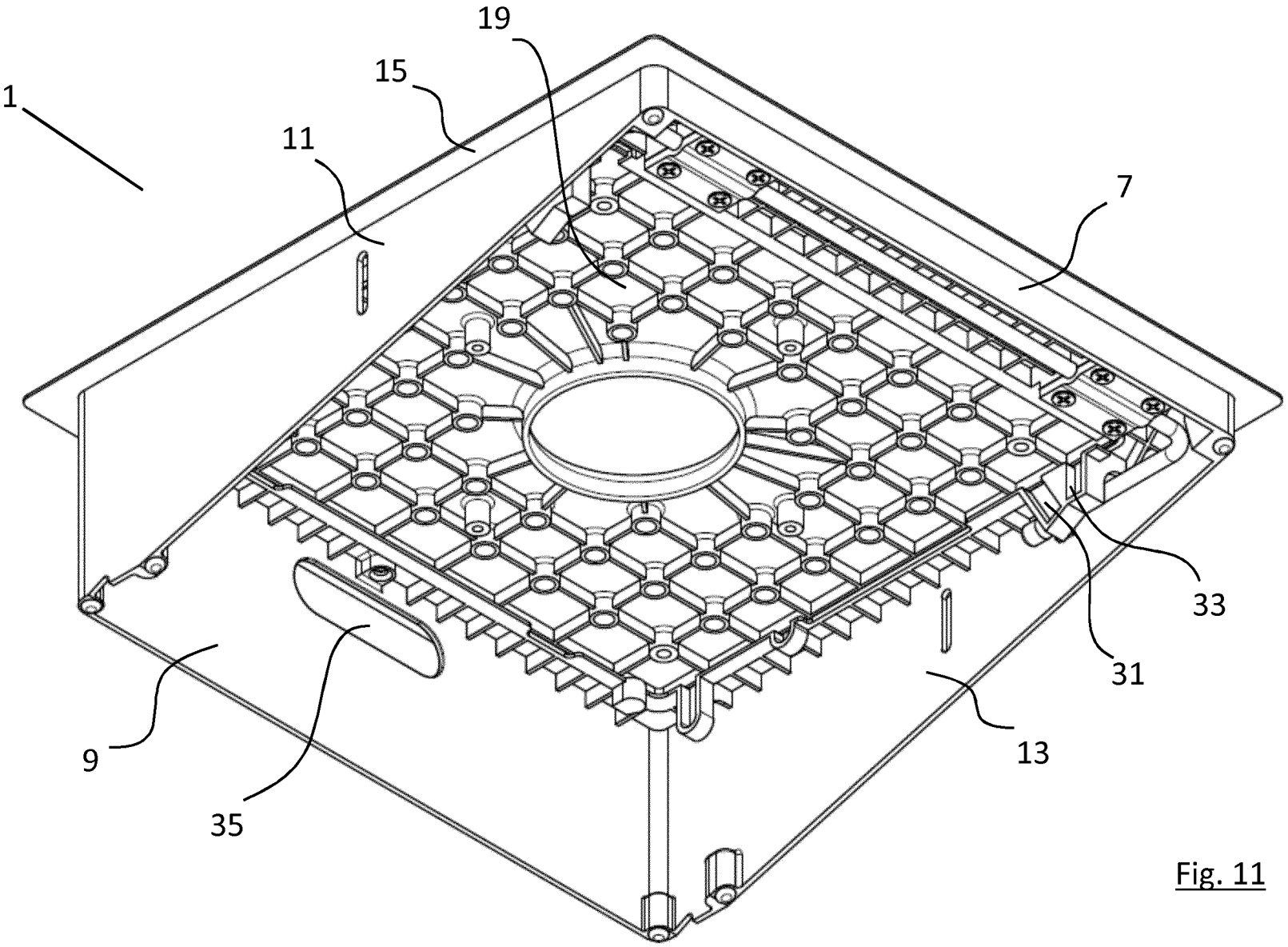
FIG. 11 is a front perspective view from underneath of the tilt board of FIG. 1.

Referring specifically to FIGS. 10 and 11, there is shown a pair of channels 31, 33 formed into the side wall of the aperture that provide an alternative way of tilting the removable activity surface insert 19 relative to the remainder of the tilt board to that shown in FIG. 12. There are provided a pair of corresponding channels on the opposite side wall of the aperture. The side edge (not shown) of the removable activity surface insert 19 can be simply slid into one of the pair of channels 31, 33 and the removable activity surface insert 19 will be held in a tilted configuration. There is further shown a handle cut-out 35 in the rear wall 9 that will allow the tilt board to be handled with ease.

Figure 13:
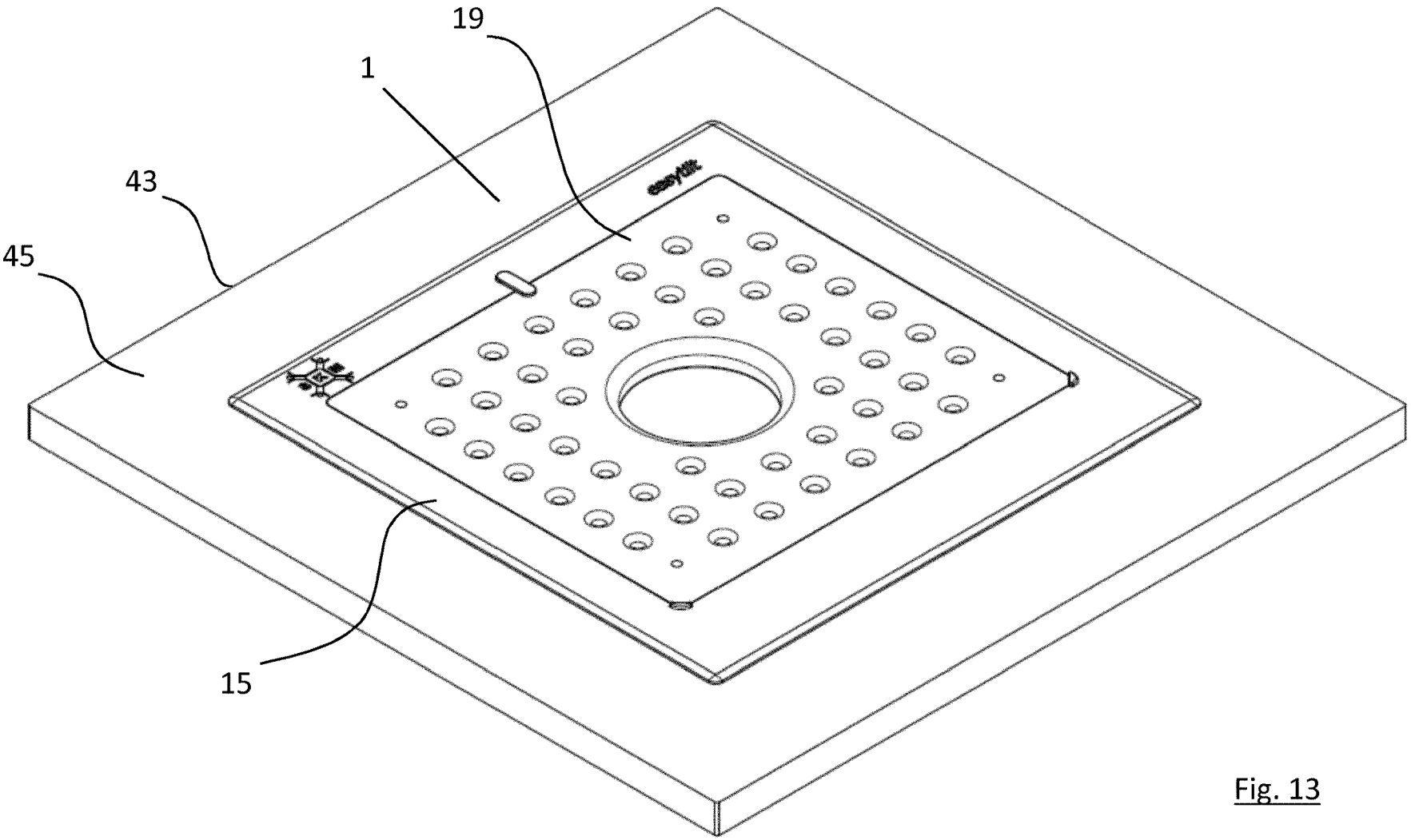
FIG. 13 is a perspective view of the tilt board inserted into an aperture in a larger work surface.
Figure 14:
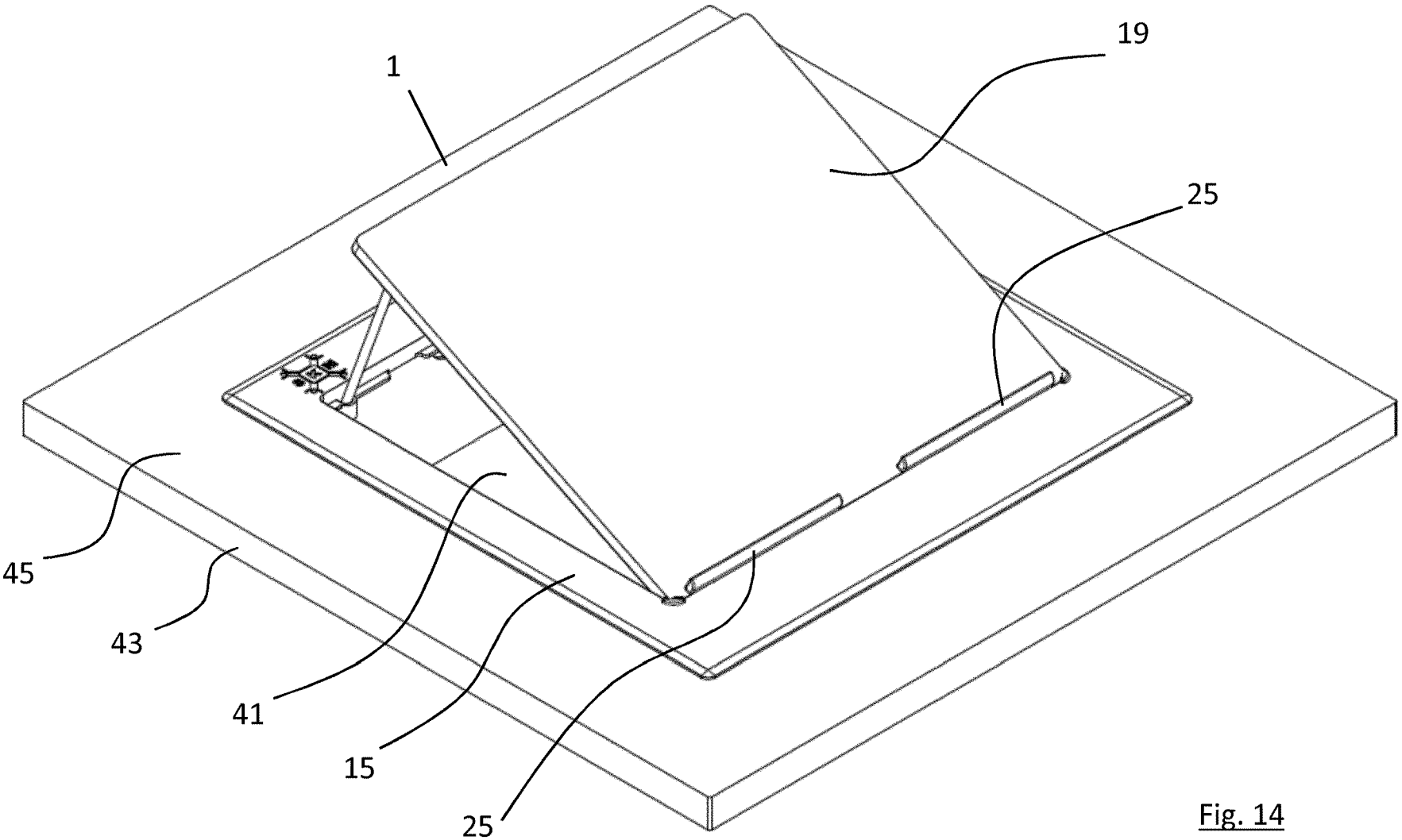
FIG. 14 is a perspective view of the tilt board inserted into an aperture in a larger work surface with the activity surface insert in a first inclined configuration.
Figure 15:
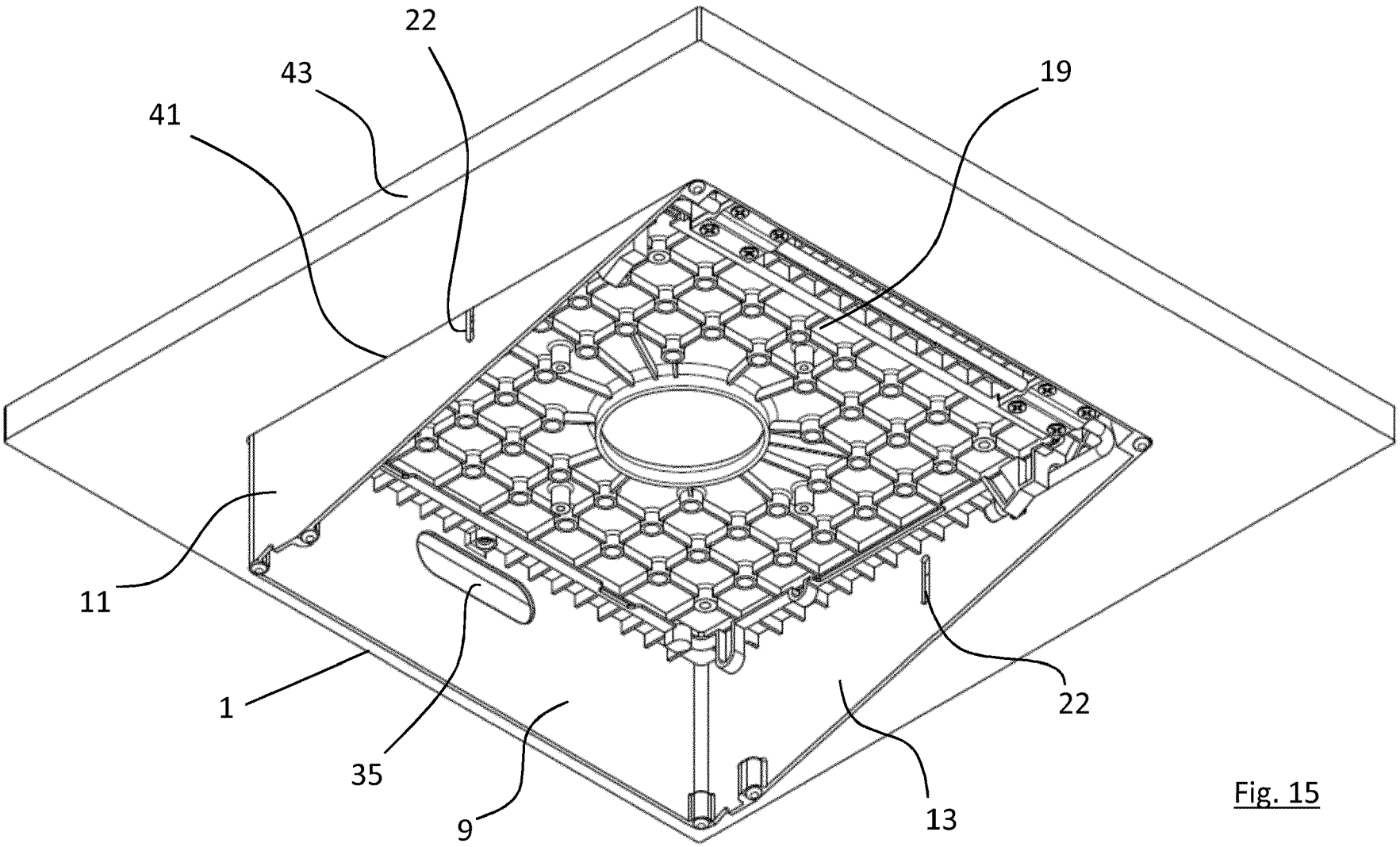
FIG. 15 is a perspective view from below of the tilt board inserted into an aperture in a larger work surface.

Referring now to FIGS. 13 to 15 inclusive, there is shown a number of views of the tilt board 1 according to the invention inserted into an aperture 41 of another, larger work surface, in this case a table 43, only part of which is shown. The circumferential flange of the activity surface surround sits on the top surface 45 of the table 43 preventing further downward movement of the tilt board whereas at least portion of the tilt board including the base will have traveled through the aperture 41 in the table.

Referring specifically to FIG. 14, there is shown an alternative construction of removable activity surface insert 19 in the tilt board, in an inclined configuration relative to the remainder of the tilt board. The removable activity surface insert 19 comprises an elongate upstanding boss 47 extending at least partially along one edge of the removable activity surface insert 19. It can be seen from FIG. 14 that the retaining stops 20 allow the removable activity surface insert 19 to be tilted by a limited amount.

Referring specifically to FIG. 15, it can be seen that there is provided a pair of elongate slots 22 in the side walls 11, 13 of the tilt board 1. If desired, the tilt board can be held in position relative to the table 43 in which it is mounted by inserting bolts (not shown) through the slots 22 below the table 43 and securing the bolts in position with nuts and washers (not shown) if desired. The presence of a bolt will prevent the tilt board from being lifted out of the aperture 41 in the table 43. The slots 22 are elongate to accommodate different depths of table work tops.

Figure 16:
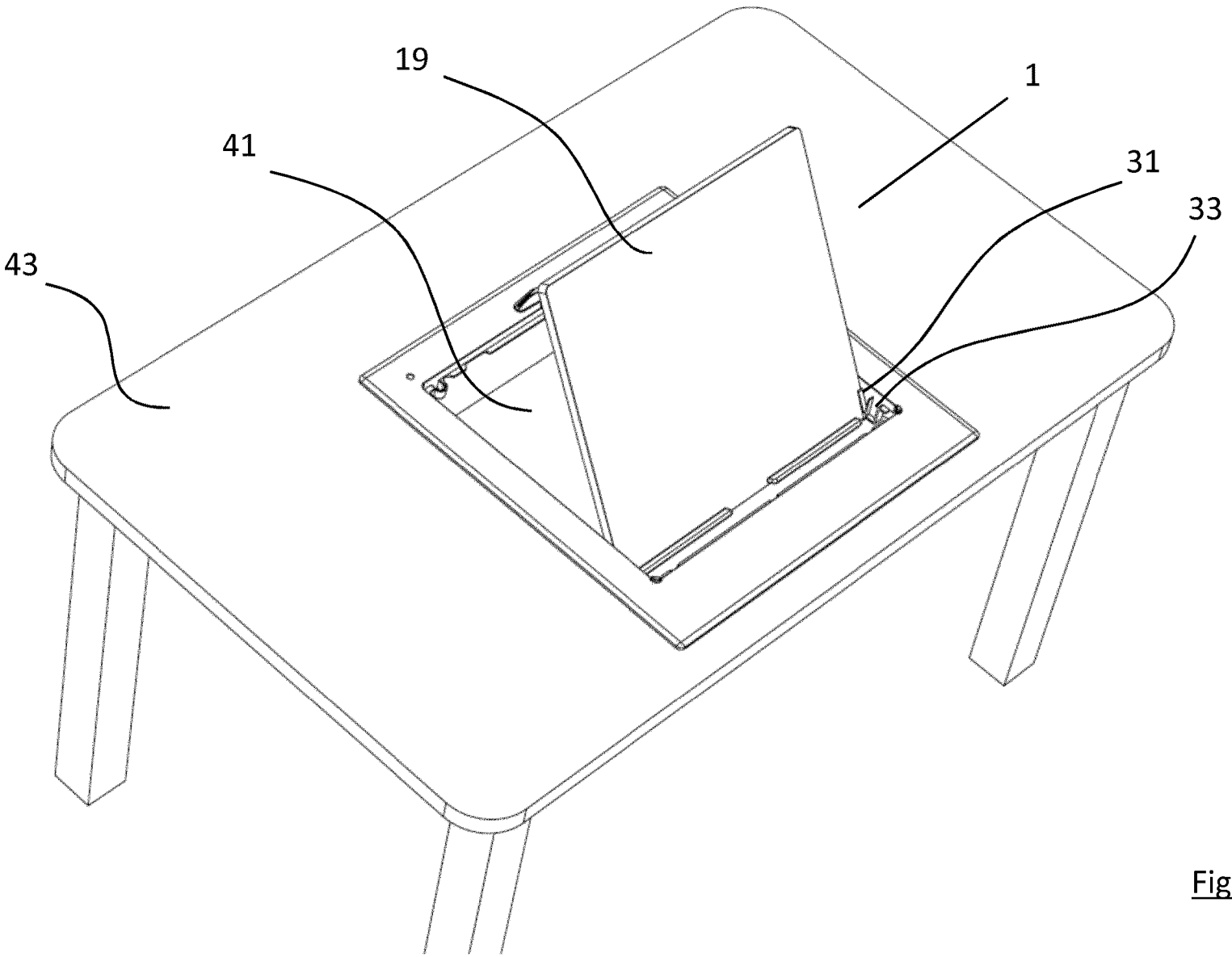
FIG. 16 is a perspective view of the tilt board inserted into an aperture in a larger work surface with the activity surface insert mounted in a first pair of channels.
Figure 17:
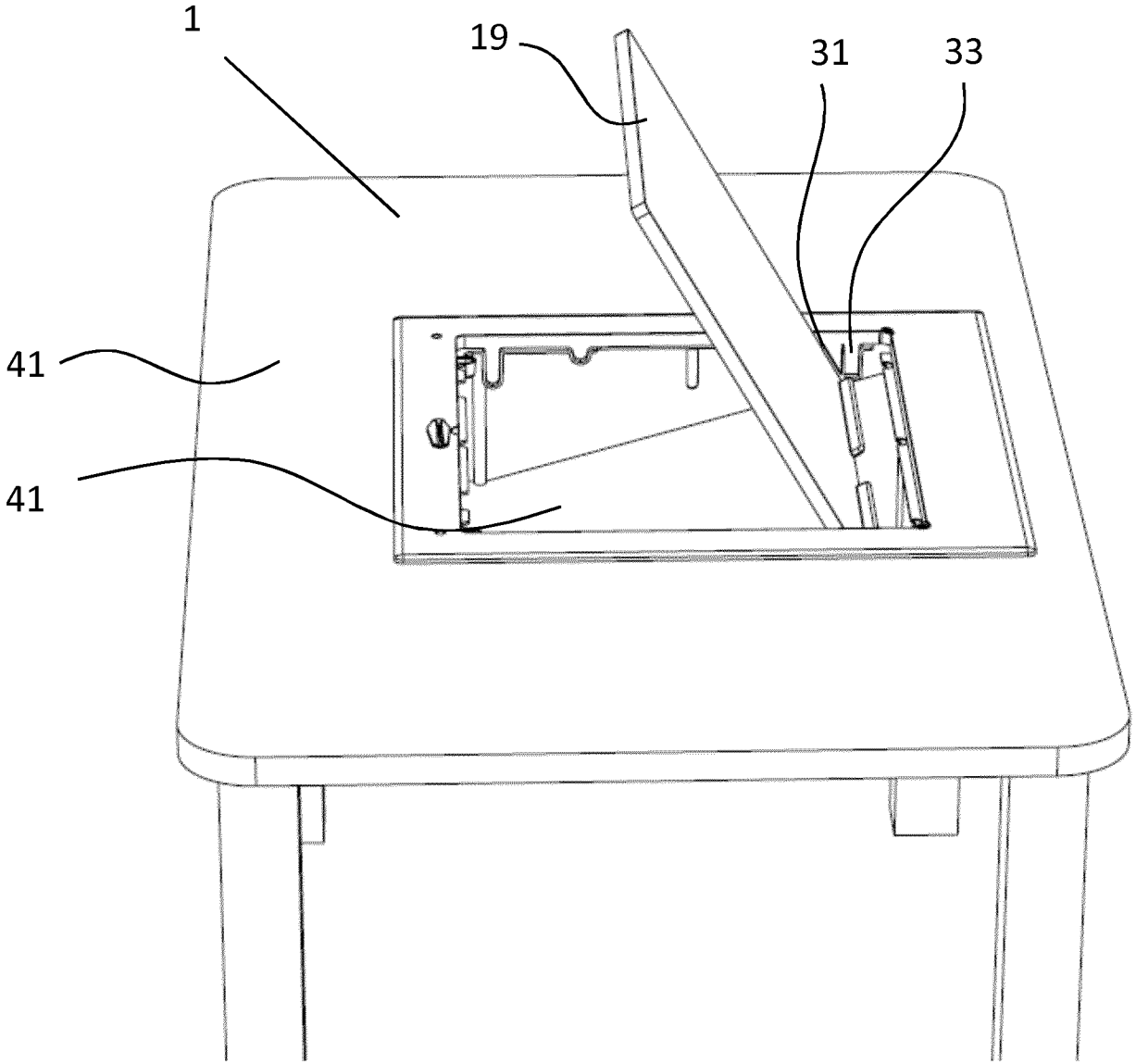
FIG. 17 is a side view of the tilt board shown in FIG. 16.
Figure 18:
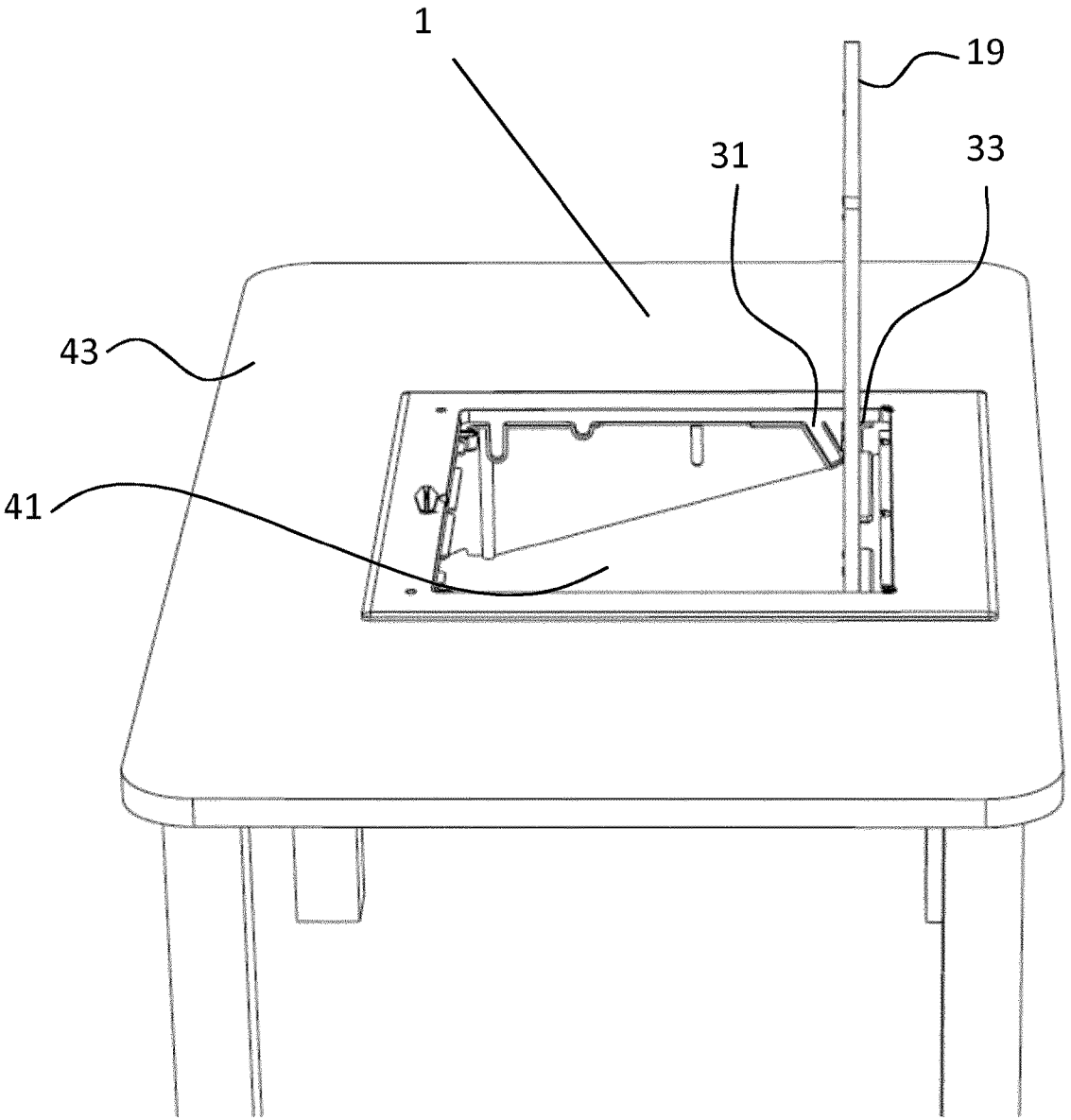
FIG. 18 is a side view of the tilt board inserted into an aperture in a larger work surface with the activity surface insert mounted in a second pair of channels.

Referring to FIGS. 16 to 18 inclusive, there is shown a plurality of views of the removable activity surface insert 19 mounted in each of the pair of channels 31, 33 to tilt the removable activity surface insert 19 relative to the remainder of the tilt board. Referring first of all to FIGS. 16 and 17, the side edge of the removable activity surface insert 19 is slid into a first channel 33. The other side edge obscured from view is slid into a complementary channel on the opposite side wall of the aperture 17. It can be seen that the removable activity surface insert 19 is inclined at a first angle relative to the remainder of the tilt board. Referring now to FIG. 18, the side edge of the removable activity surface insert 19 is slid into a second channel 31. Again, the other side edge of the removable activity surface insert that is obscured from view is slid into a complementary channel on the opposite side wall of the aperture 17. It can be seen that the removable activity surface insert 19 is inclined at a second, more upright, angle relative to the remainder of the tilt board. In the embodiments shown in FIGS. 16-18 inclusive, the tilt board is again inserted into an aperture 41 of another larger work surface. In this case a table 43.

Figure 19:
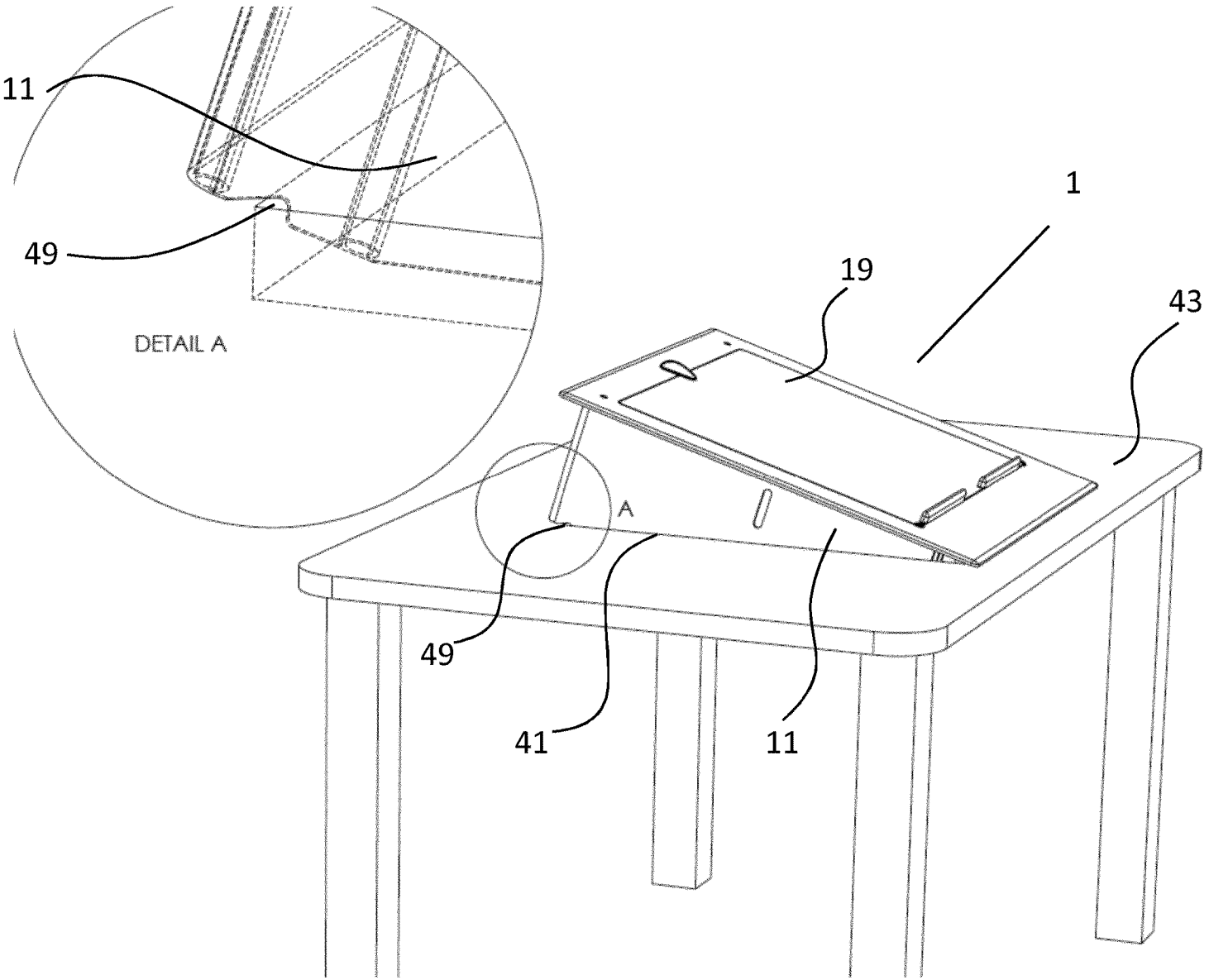
FIG. 19 is a perspective view of the tilt board inserted into an aperture in a larger work surface with the tilt board resting on notches formed in the side walls.

Referring to FIG. 19, there is shown a perspective view of the tilt board mounted in the aperture 41 of a table 43 and tilted in a different manner to the ways previously described. The tilt board 1 has a pair of notches 49, one in each side wall 11, 13 adjacent the rear wall 9. In the embodiment shown, the notches 49 are rested on the table 43 and the front wall 7 of the base 5 is lowered into the aperture 41 in the table 43. The circumferential flange of the activity surface surround 15 sits on the top surface 45 of the table 43 preventing further downward movement of the tilt board. The tilt board is prevented from moving backwards or forwards by the notches 49 and the front wall 7.

Figure 20:
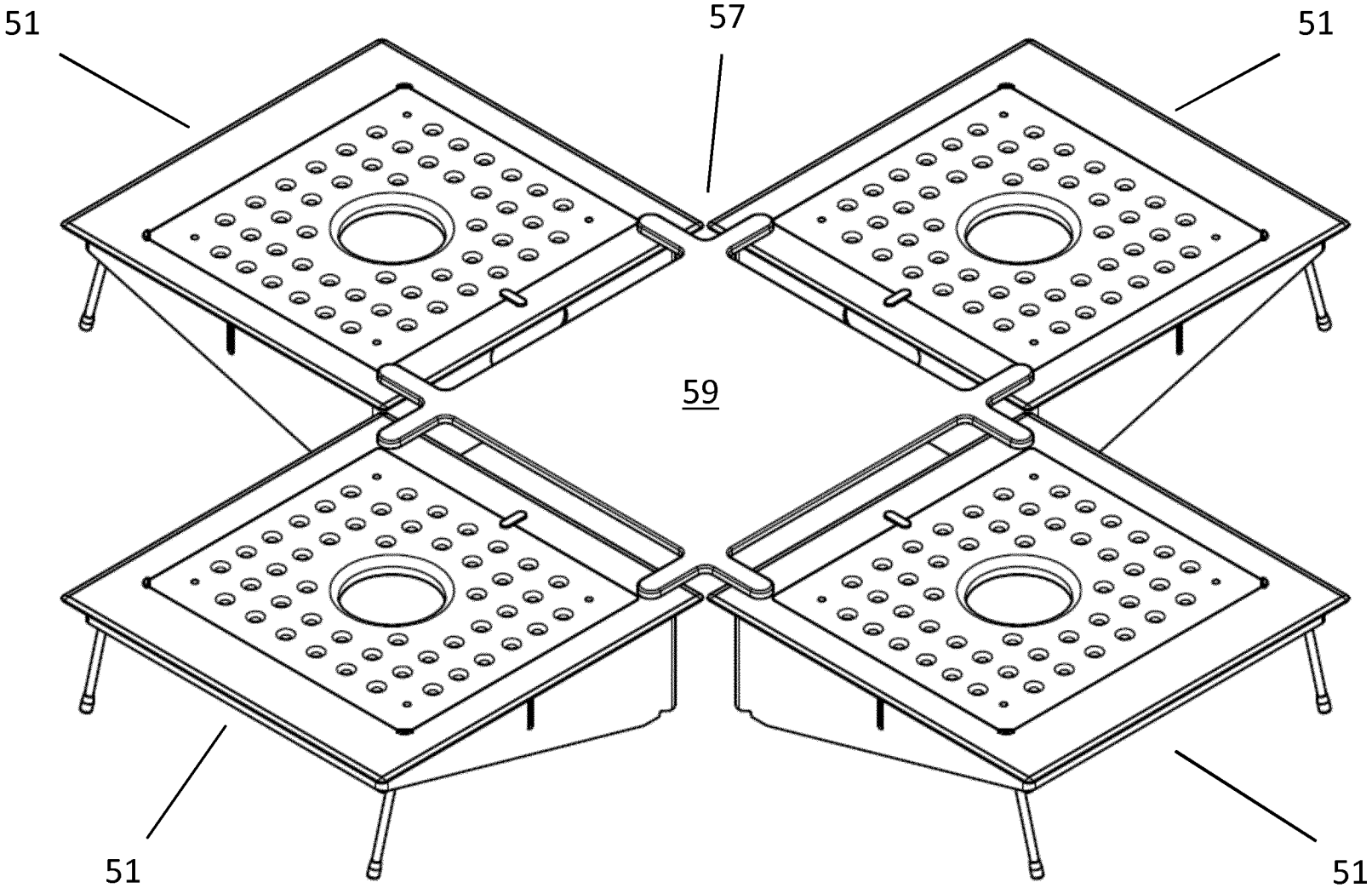
FIG. 20 is a perspective view of a plurality of tilt boards connected together.
Figure 21:
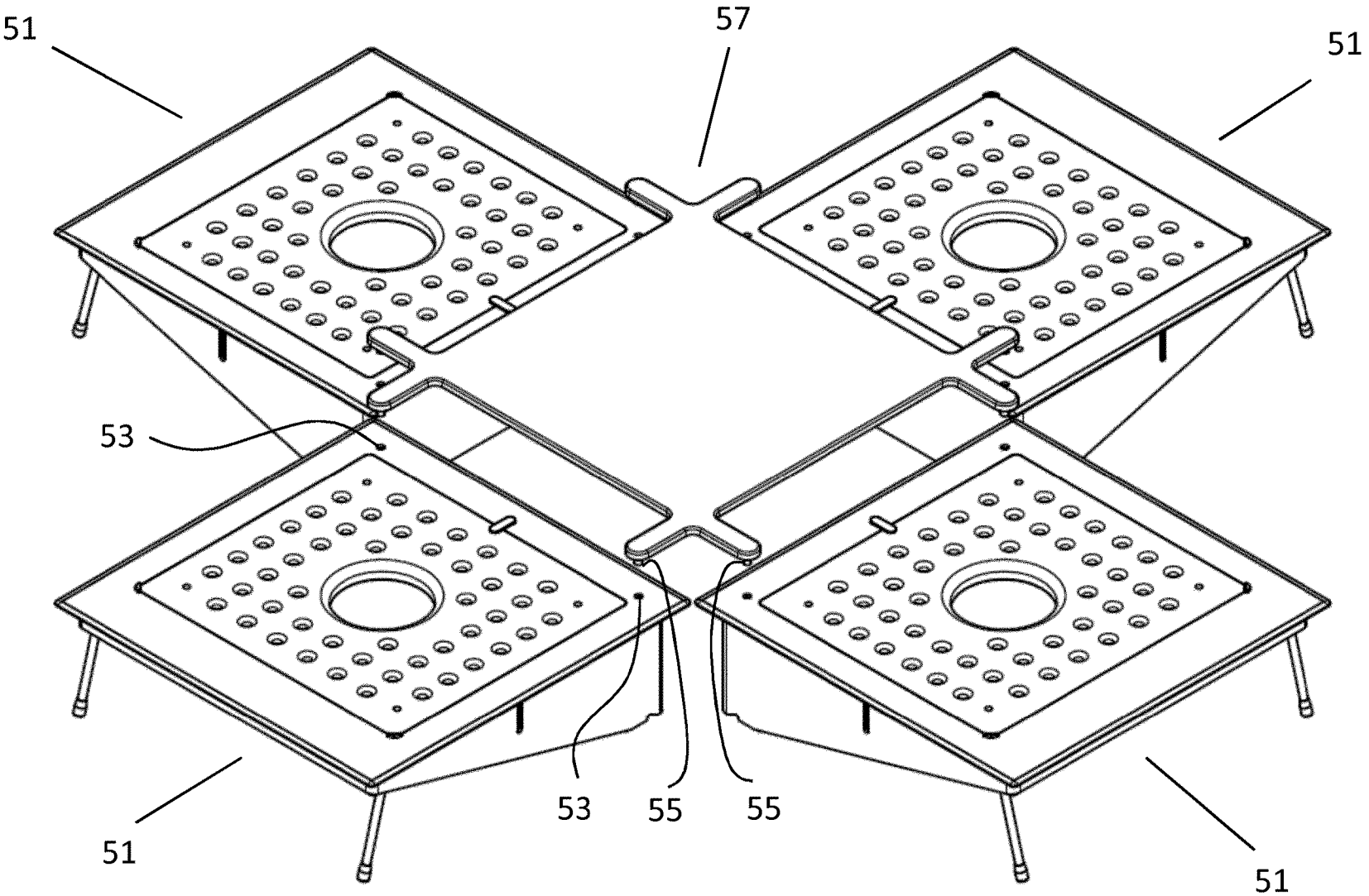
FIG. 21 is a perspective view of a plurality of tilt boards prior to being connected together with a dedicated connector.

Referring to FIGS. 20 and 21, there is shown another embodiment of tilt board according to the invention, indicated generally by the reference numeral 51, and where like parts have been given the same reference numeral as before. The tilt boards differ from the embodiments described before in that the tilt boards 51 are provided with apertures 53 for reception of interlocking spigots 55 of an interconnector 57. In the embodiment shown in FIG. 20, a plurality of tilt boards 51 have been connected together using the interconnector 57. This is achieved by inserting one or more of the spigots 55 of the interconnector 57 into apertures 53 in the tilt boards 51 which will hold the tilt board 53 in position relative to the interconnector 57 and any other tilt boards 51 connected thereto.

In the embodiment shown in FIGS. 20 and 21, four tilt boards are connected together in a cross configuration. However, it will be readily understood that more or less tilt boards could be connected together and indeed other shapes of interconnectors could be provided that will allow different numbers of tilt boards to be connected together. For example, a triangular interconnector could be provided to connect (at most) three tilt boards together. Furthermore, the interconnector 57 shown in the drawings has a central body work surface 59 that may be useful in gameplay however it is envisaged that it may not be necessary to have the central body worksurface and the interconnector could be provided by way of very simple connector bars with spigots that could interconnect two (or more if necessary) tilt boards together.

Figure 22:
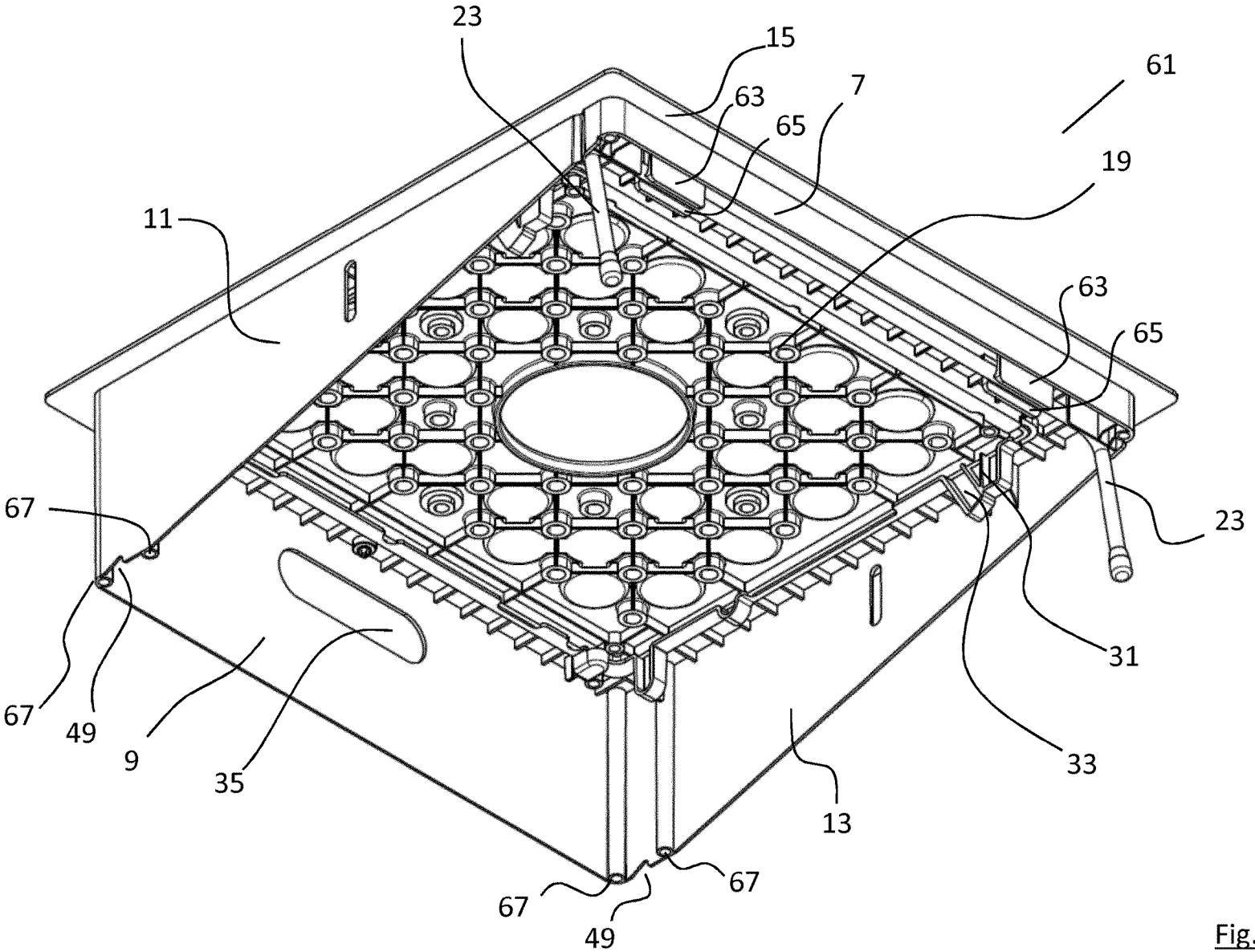
FIG. 22 is a front perspective view from underneath of an alternative embodiment of tilt board according to the invention.
Figure 23:
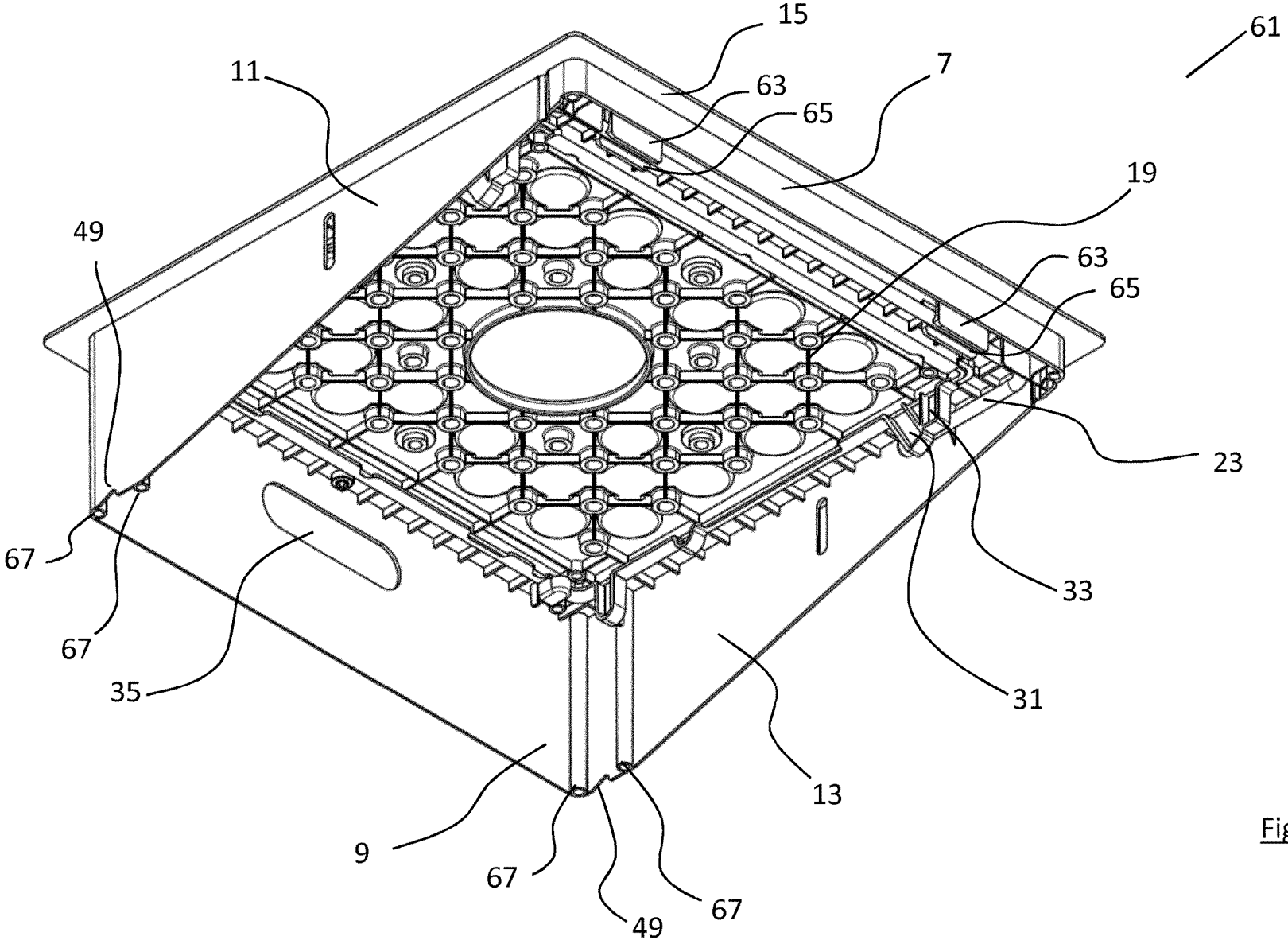
FIG. 23 is a front perspective view from underneath of the alternative embodiment of the tilt board shown in FIG. 22.

Referring to FIGS. 22 and 23, there is shown an alternative embodiment of tilt board according to the present invention, indicated generally by the reference numeral 61 and where like parts have been given the same reference numeral as before. The tilt board 61 is similar to the tilt board 1 shown in FIGS. 10 and 11 in which the tilt board support leg 23 is shown in a deployed and a stowed configuration respectively. The tilt board 61 shown in FIGS. 22 and 23 differs from the tilt board 1 shown in FIGS. 10 and 11 in that the tilt board support leg 23 is retailed in place by a pair of opposing jaws 63, 65 instead of a mounting plate screwed into position as is the case in the tilt board 1 shown in FIGS. 10 and 11.

The jaws 63, 65 are sufficiently resiliently deformable to allow the tilt board support leg 23 to be inserted therebetween and to retain the tilt board support leg 23 once it is in position between the jaws 63, 65. Once in position, the tilt board support leg 23 can pivot about its main longitudinal axis to and from a stowed configuration (FIG. 23) and a deployed configuration (FIG. 22). Advantageously, this will reduce the construction costs and assembly time required to assemble the tilt board as there will be no additional parts or screws required to attach the tilt board support leg 23 to the tilt board 61. Furthermore, the tilt board may be provided without the tilt board support leg 23 and the tilt board support leg 23 can be provided separately as an additional extra. In addition to the foregoing, there are provided a plurality of rubber shoes 67 arranged around the notches 49 to prevent slippage of the tilt board.

Figure 24:
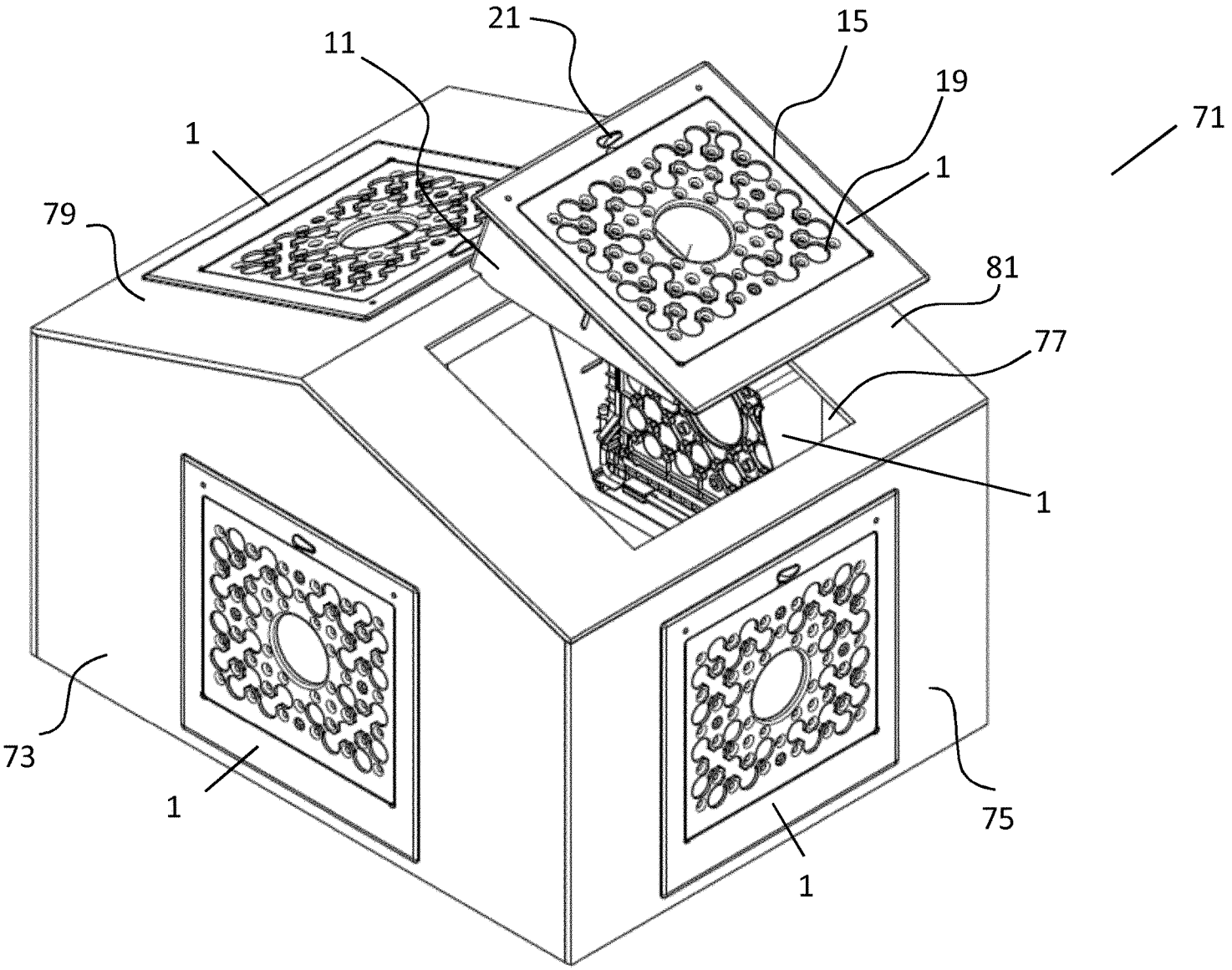
FIG. 24 is a perspective view of a plurality of tilt boards according to the invention in use.

Referring to FIG. 24, there is shown a perspective view of a plurality of tilt boards 1 according to the invention in use. The plurality of tilt boards are shown mounted about a multi-faceted structure, indicated generally by the numeral 71 having a plurality of sides 73, 75, 77 only three of which are shown, and a pitched roof having a pair of roof sections 79, 81. The sides 73, 75, 77 and the pitched roof sections 79, 81 each have an aperture 83 therein for reception of a tilt board therein. A fastener (not shown), for example a nut and bolt, may be provided in the slots 22 in the side walls 11, 13 of the base of the tilt board in order to hold the tilt board in position relative to the side 73, 75, 77 or the pitched roof section 79, 81. In this way, a number of different activity surface inserts may be provided in the tilt boards mounted in the different sides and roof sections thereby providing different activities that can be enjoyed around the structure 71.

Figure 25:
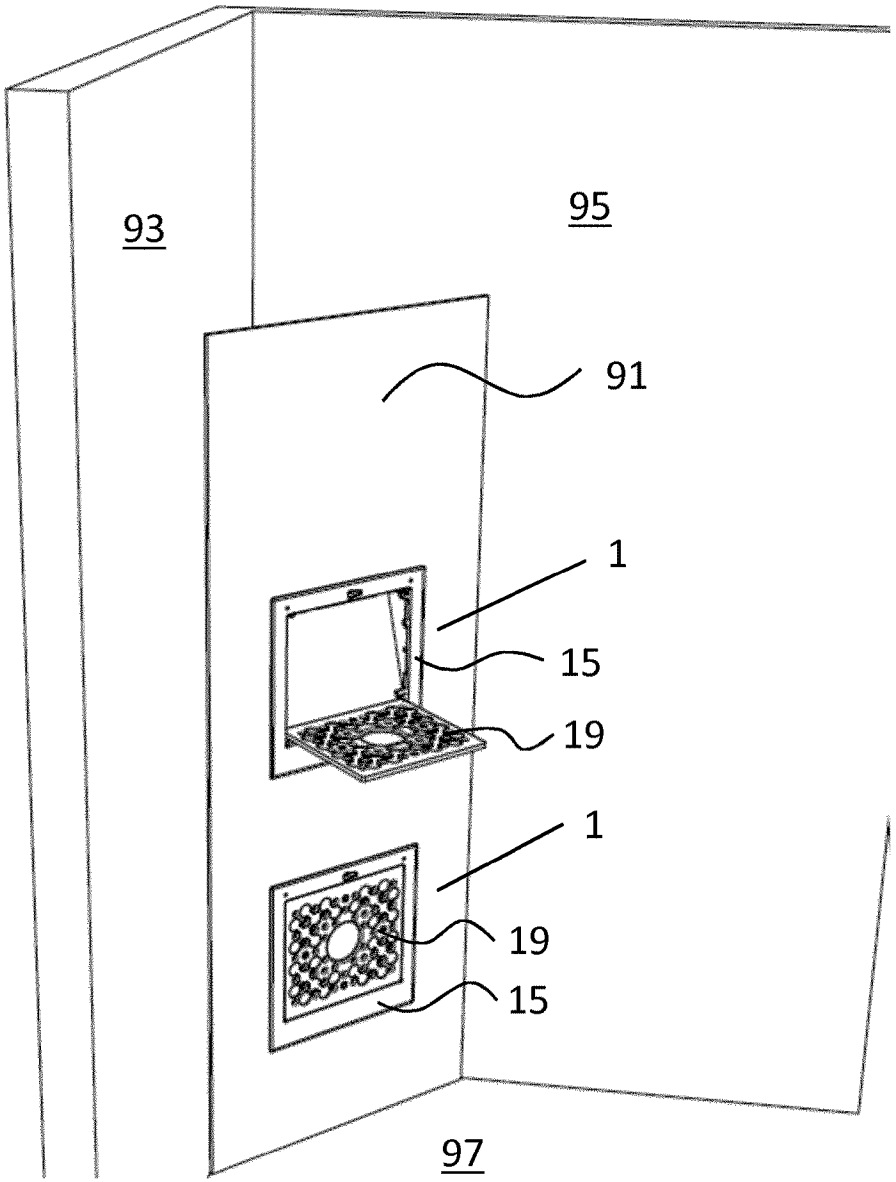
FIG. 25 is a perspective view of a plurality of tlt boards according to the invention in use.

Referring to FIG. 25, there is shown a plurality of tilt boards mounted in a wall 91. The wall 91 is preferably a wooden or plaster sheet that is mounted in a corner between two walls 93, 95 however this is for illustrative purposes only and is not deemed to be limiting. Other configurations are readily envisaged. The tilt boards 1 mounted in the wall 91 are shown in two different configurations. The tilt board 1 closest to the floor 97 has the activity surface insert 19 mounted substantially co-planar with the wall 91 and the activity surface surround 15 of the tilt board 1 whereas the tilt board above mounted higher on the wall 91 is configured with the activity surface insert 19 mounted substantially perpendicular to the wall 91 and the activity surface surround 15 of that tilt board 1.

Figure 26:
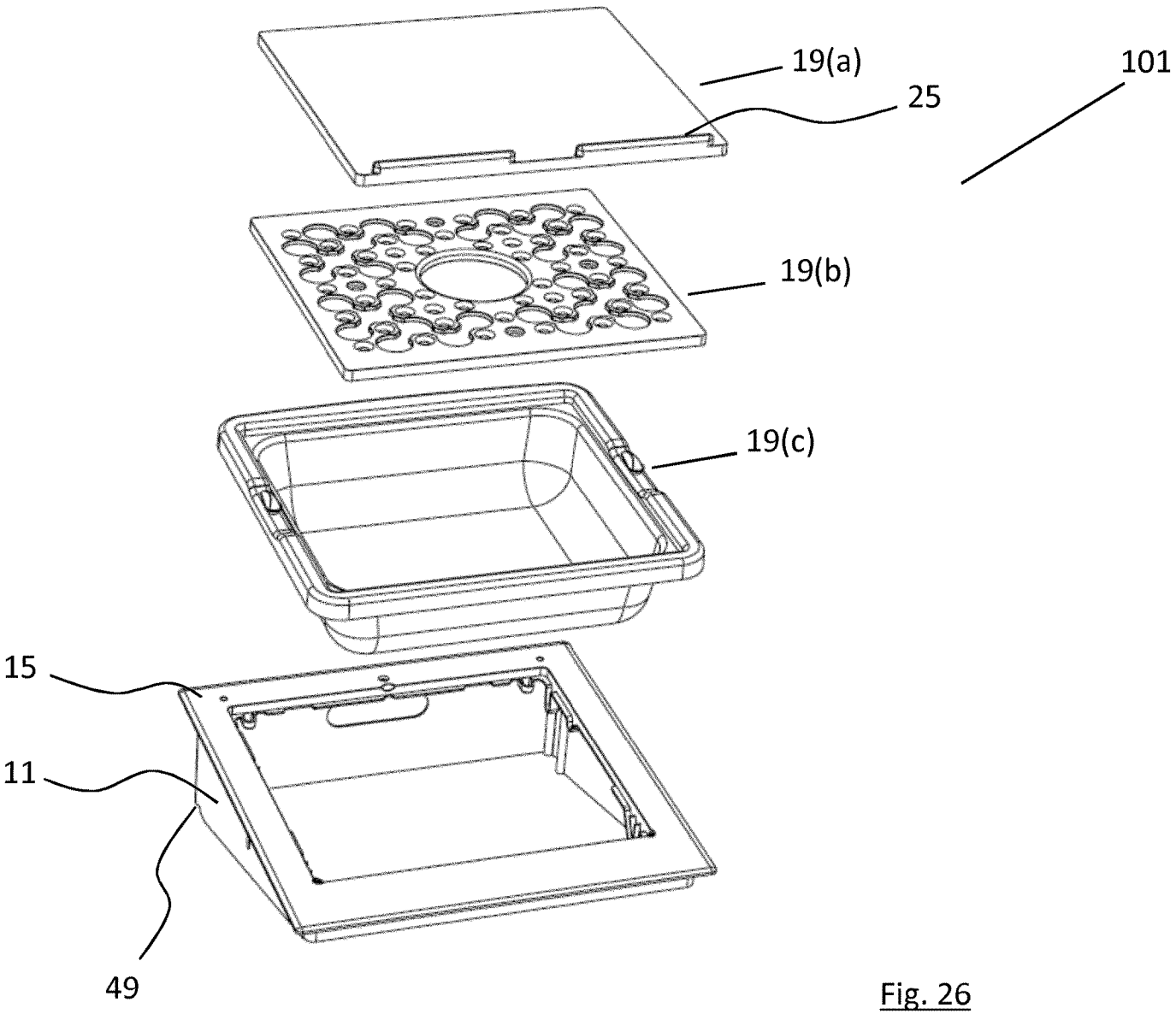
FIG. 26 is an exploded view of a further embodiment of tilt board according to the invention.

Referring now to FIGS. 26 to 31 inclusive, there is shown a further alternative embodiment of tilt board, indicated generally by the reference numeral 101. Referring specifically to FIG. 26, there is shown an exploded view of the tilt board 101 in which it can be seen that the tilt board 101 comprises a plurality of activity surface inserts 19(*a*), 19(*b*) and 19(*c*). The activity surface insert 19(*a*) is similar to the activity surface insert shown in conjunction with the tilt board in FIG. 12. The activity surface insert 19(*b*) is similar to the activity surface insert shown in conjunction with the tilt board 1 in FIG. 24. The activity surface insert 19(*c*) comprises a basin that is dimensioned to fit in the aperture of the tilt board 101 with an outwardly extending circumferential flange that rests upon the activity surface surround 15. The main body of the tilt board is similar to those shown in FIGS. 1 to 25 inclusive.

Figure 27:
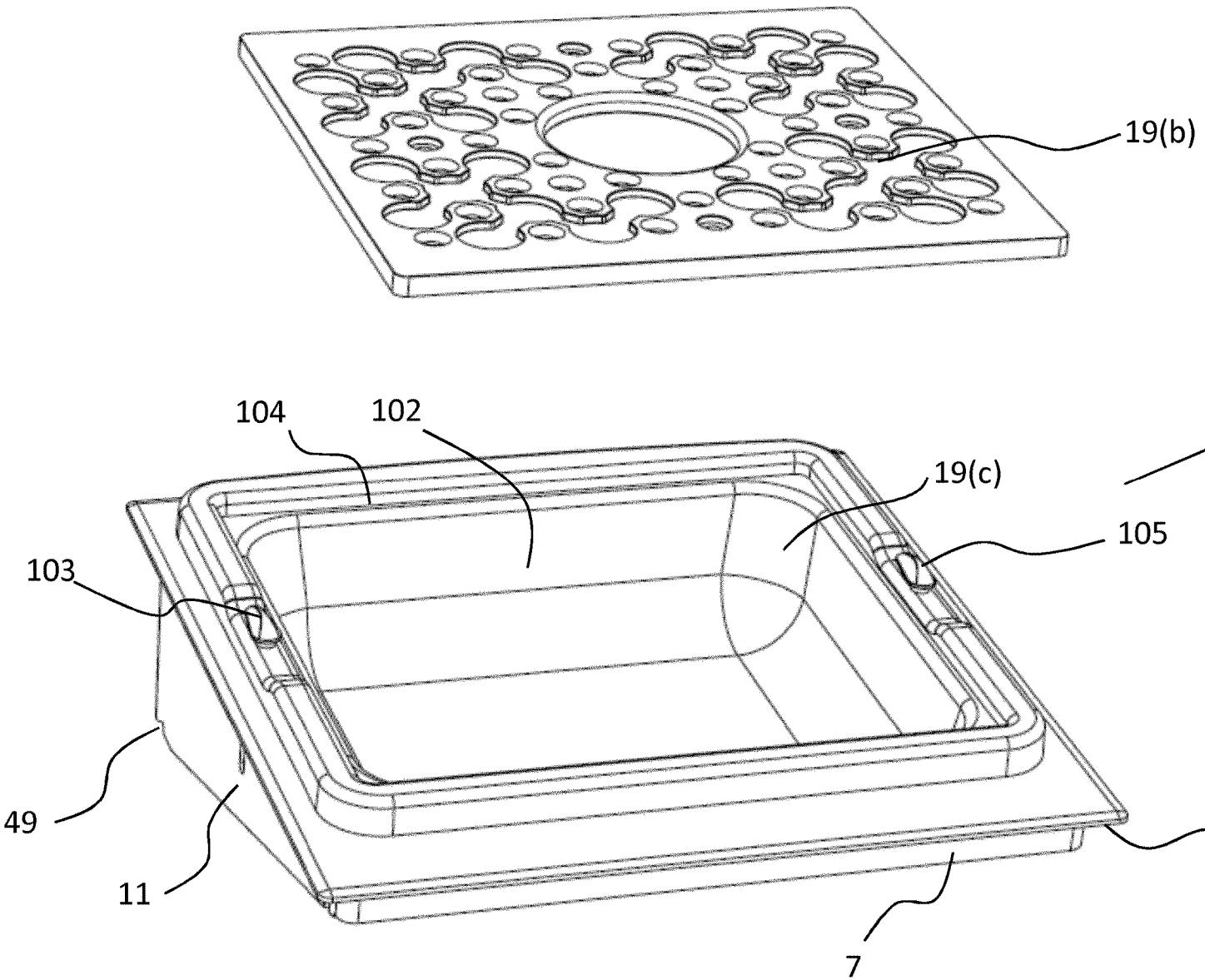
FIG. 27 is exploded partially constructed view of the tilt board of FIG. 26.

Referring specifically to FIG. 27, the activity surface insert 19(*c*) is shown inserted in the aperture of the tilt board 101. The activity surface insert 19(*c*) is suitable for holding sand, water or other objects and the activity surface insert 19(*c*) defines an open mouth 102 having a seat 104 dimensioned to receive another activity surface insert, in this case activity surface insert 19(*b*) is shown. The activity surface insert 19(*c*) has a pair of rotatable latches 103, 105 operable to releasably secure the activity surface insert 19(*b*) in position.

Figure 28:
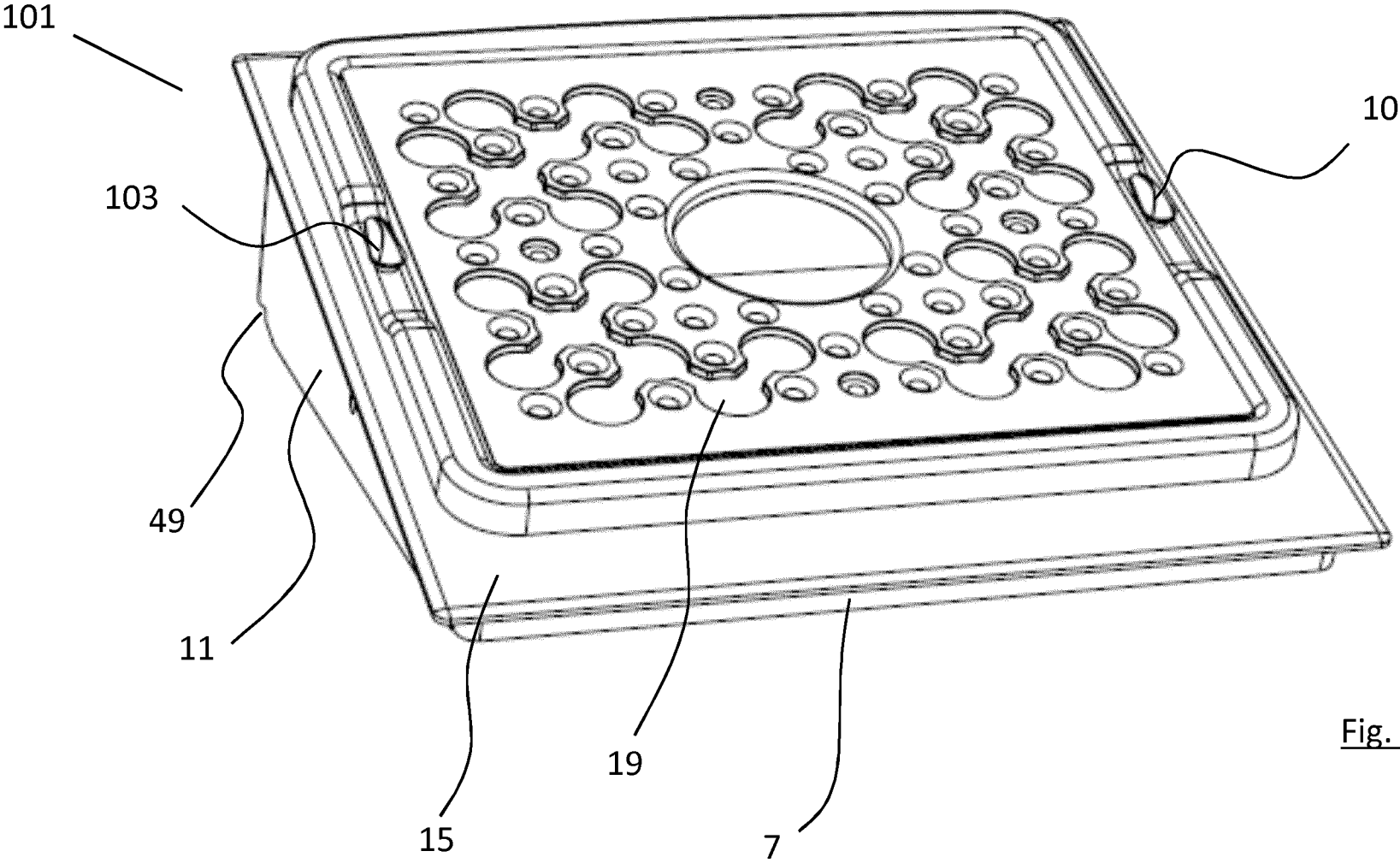
FIG. 28 is a perspective view of the tilt board shown in FIGS. 26 and 27 fully assembled.
Figure 31:
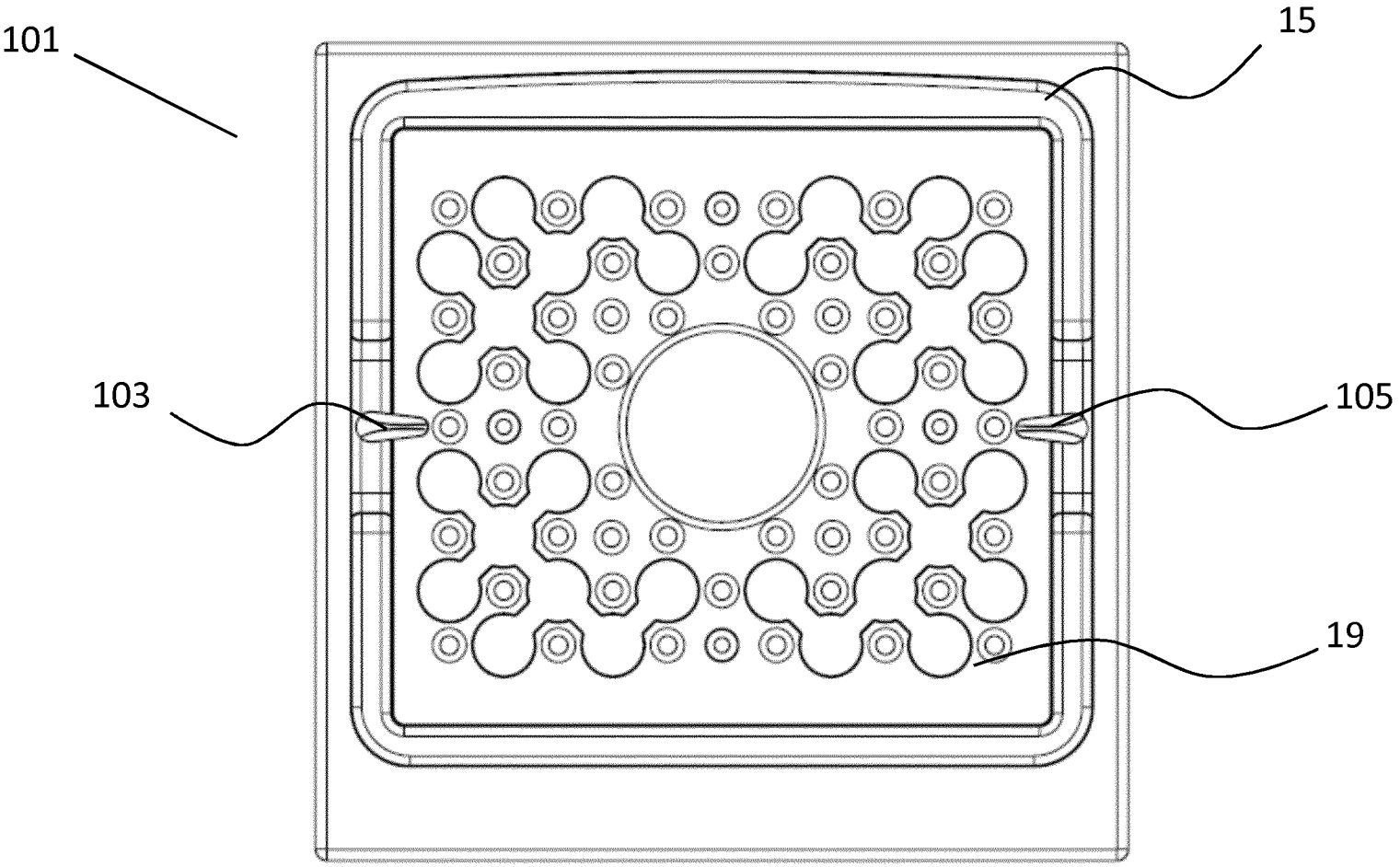
FIG. 31 is a top plan view of the tilt board of FIG. 28 with the activity board insert locked in position.

Referring now to FIGS. 28 and 31, in FIG. 28, the activity surface insert 19(*b*) is inserted into the open mouth 102 and rests on the seat 104 of the activity surface insert 19(*c*) and the rotatable latches 103, 105 are shown in a release configuration in which the activity surface insert 19(*b*) is free to be released from the activity surface insert 19(*c*). In FIG. 31, the rotatable latches 103, 105 are shown in a locking configuration in which the activity surface insert 19(*b*) is held in position in the seat 104 of the activity surface insert 19(*c*).

Figure 30:
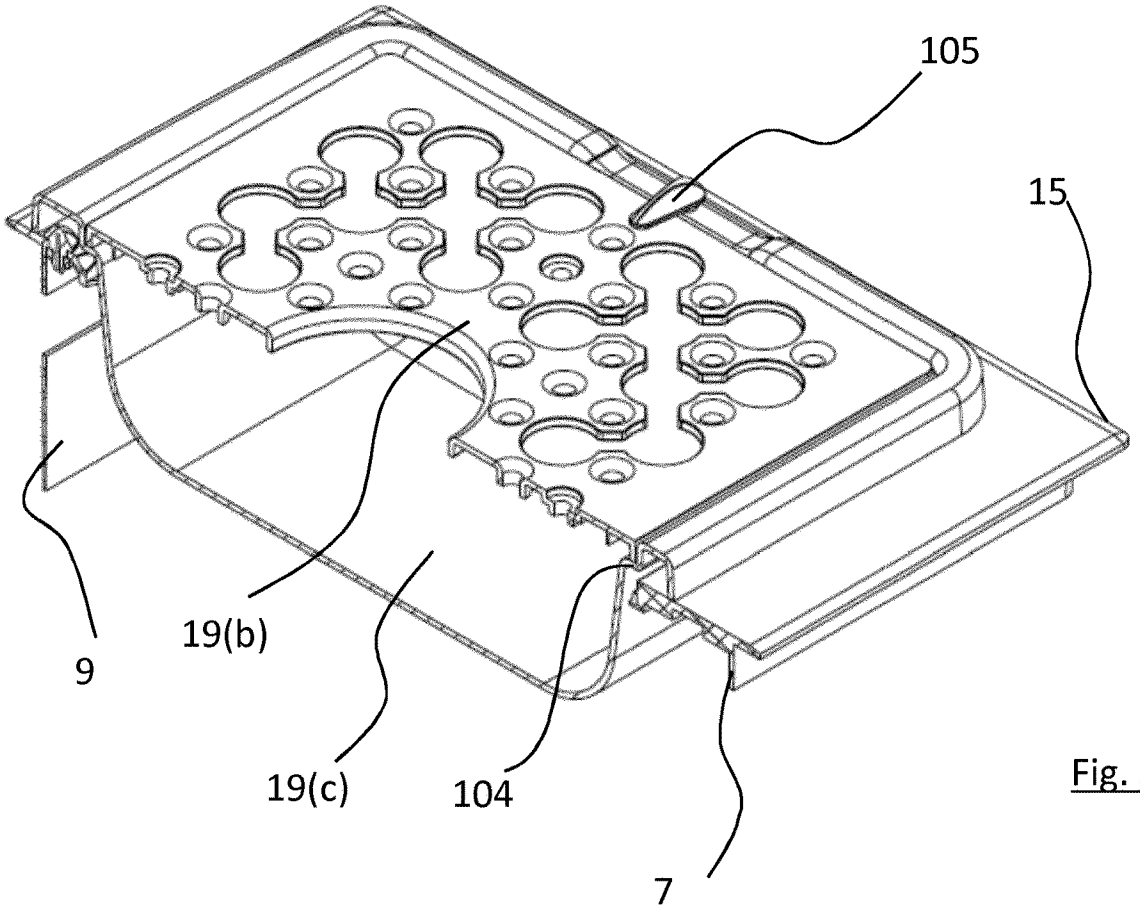
FIG. 30 is a cross-sectional view along the lines C-C of FIG. 29.
Figure 29:
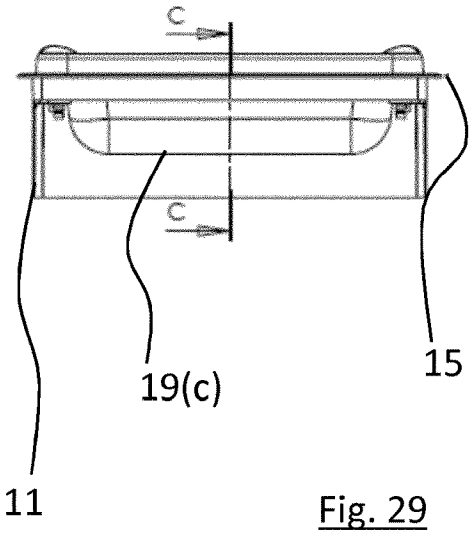
FIG. 29 is a front view of the tilt board shown in FIG. 28.

Finally, referring to FIGS. 29 and 30, there is shown a front view and a cross sectional view along the lines C-C of FIG. 29 respectively. In FIG. 30, the activity surface insert 19(*c*) is shown overlapping the activity surface surround 15 about the aperture 17. The activity surface insert 19(*b*) rests on the seat 104 provided by the activity insert 19(*c*).

It can be seen from the foregoing that various different surfaces may be employed for the removable activity surface insert 19 and the angle of tilt of the removable activity surface insert 19 may be adjusted to suit the activity. Accordingly, the functionality and usefulness of the tilt board according to the invention has been improved. In the embodiment shown, the tilt board will be constructed from a moulded plastic material however other materials could be used if desired. It will be understood that various modifications to the embodiments hereinbefore described may be made without departing from the scope of the present invention.

It will be further understood from the foregoing, that an advantage of the present invention is the flexibility of the tilt board according to the invention. Unlike other tilt boards, the tilt board is designed so that it can be inserted into an aperture in a table or a wall and have the activity surface lie flat along the plane of the table or the wall. This is highly advantageous as the tilt board will not always have to be tilted relative to the surface on which it is mounted. In this way, the tilt board can be mounted in tables, floors, walls or even ceilings if desired. The tilt board can be used to store game pieces and indeed could even be back lit if desired. The activity surface inserts 19 described above are not solely restricted to use with the tilt boards and it is envisaged that the activity surface inserts could be used separately without the tilt board. This will allow the user get the most out of their products.

Furthermore, although the tilt board according to the present invention is deemed particularly suitable for use in a teaching environment for kids and adults with learning difficulties and or physical and or intellectual disabilities, it is envisaged that the tilt board according to the invention could be used in the home or in other private or public environments. For example, the tilt board might be particularly suitable for caches, junior schools, activity centers, day care establishments and the like. It is further envisaged that a wide selection of activity surface inserts 19 could be provided induding, but not limited to, those shown in the accompanying drawings. In addition to the activity surface inserts shown, other activity surface inserts such as a white board surface, a blackboard surface, a magnetic surface, a mirror surface, a surface bearing a photographical and or pictorial image, a game board surface including, but not limited to a sticky (i.e. Velcro) ball surface, a draughts (checkers) surface, a chess board surface, a tic-tac-toe surface, a shape matching board, a ring board, a dart board, a target, a puzzle or other game surface could be provided. Indeed, the activity surface inserts may be two sided and have a different activity surface on either side.

In this specification the terms "comprise, comprises, comprised and comprising" and the terms "include, includes, included and including" are all deemed totally interchangeable and should be afforded the widest possible interpretation.

The invention is in no way limited to the embodiments hereinbefore described but may be varied in both construction and detail within the scope of the claims.

The invention claimed is:

1. A tilt board comprising an activity surface supported by a base, the activity surface comprising an activity surface surround defining an activity surface insert receiving aperture therein and a removable activity surface insert dimensioned for close-fit reception in the aperture, and in which the base comprises a front wall and a rear wall extending downwardly from the activity surface perpendicular to the plane of the activity surface surround, the rear wall extending downwardly from the activity surface by a greater distance than the front wall, and in which there is provided means to adjust the tilt angle of the removable activity surface insert relative to the activity surface surround.

2. The tilt board as claimed in claim 1 in which the activity surface surround comprises a circumferential flange extending outwardly from the base.

3. The tilt board as claimed in claim 1 in which the base further comprises a pair of side walls bridging the gap between the front wall and the rear wall at either ends of the front wall and the rear wall.

4. The tilt board as claimed in claim 3 in which there is provided a notch in each of the side walls adjacent the rear wall.

5. The tilt board as claimed in claim 1 in which the means to adjust the tilt angle of the removable activity surface insert relative to the activity surface surround comprises: a support arm mounted on one of the activity surface insert and the activity surface surround; and, a support arm receiver located on the other of the activity surface insert and the activity surface surround.

6. The tilt board as claimed in claim 5 in which the support arm is hingedly mounted so that it may be transitioned to and from one of an operating position and a stowed position.

7. The tilt board as claimed in claim 1 in which the means to adjust the tilt angle of the removable activity surface insert relative to the activity surface surround comprises an inclined channel formed in a side wall of the activity surface insert receiving aperture in the activity surface surround, the channel being dimensioned to receive at least part of a side edge of the activity surface insert therein.

8. The tilt board as claimed in claim 7 in which there is provided a plurality of inclined channels formed in the side wall of the activity surface insert receiving aperture in the activity surface surround, the plurality of inclined channels being nonparallel with respect to each other to provide a range of tilt angles of the removable activity surface insert relative to the activity surface surround.

9. The tilt board as claimed in claim 7 in which for each inclined channel formed in the side wall of the aperture, there is provided a complementary inclined channel dimensioned to receive at least part of a side edge of the activity surface insert therein formed in the opposite side wall of the aperture.

10. The tilt board as claimed in claim 1 in which there is provided a plurality of interchangeable removable activity surface inserts, each of which is dimensioned for reception in the activity surface insert receiving aperture.

11. The tilt board as claimed in claim 1 in which there is provided means to adjust the tilt angle of the tilt board relative to the surface on which the tilt board is mounted, to and from a tilted configuration in which the activity surface is tilted relative to the surface on which the tilt board is mounted to a substantially parallel configuration in which the activity surface is substantially parallel to the surface on which the tilt board is mounted.

12. The tilt board as claimed in claim 11 in which the means to adjust the tilt angle of the tilt board relative to the surface on which the tilt board is mounted comprises a tilt board support leg mounted on the tilt board.

13. The tilt board as claimed in claim 12 in which the tilt board support leg is hingedly mounted so that it may be transitioned to and from one of an operating position and a stowed position.

14. The tilt board as claimed in claim 1 in which there is provided a retaining member for releasably securing the removable activity surface insert in the activity surface insert receiving aperture of the activity surface.

15. The tilt board as claimed in claim 14 in which the retaining member is rotatably mounted on the activity surface.

16. The tilt board as claimed in claim 1 in which there is provided a cut-out in one of the walls of the base.

17. The tilt board as claimed in claim 1 in which there is provided an elongate upstanding boss extending at least partially along one edge of the removable activity surface insert.

* * * * *